US010089878B2

(12) United States Patent
Cummings, II et al.

(10) Patent No.: US 10,089,878 B2
(45) Date of Patent: Oct. 2, 2018

(54) WRONG WAY ALERT

(71) Applicants: Kenneth R Cummings, II, Spokane, WA (US); John Lloyd Ragan, Hayden, ID (US); Chris Beaty, Post Falls, ID (US)

(72) Inventors: Kenneth R Cummings, II, Spokane, WA (US); John Lloyd Ragan, Hayden, ID (US); Chris Beaty, Post Falls, ID (US)

(73) Assignee: MDR Manufacturing Corporation, Post Falls, ID (US)

( * ) Notice: Subject to any disclaimer, the term of this patent is extended or adjusted under 35 U.S.C. 154(b) by 0 days.

(21) Appl. No.: 15/287,217

(22) Filed: Oct. 6, 2016

(65) Prior Publication Data

US 2017/0103656 A1 Apr. 13, 2017

Related U.S. Application Data

(60) Provisional application No. 62/239,789, filed on Oct. 9, 2015.

(51) Int. Cl.

| | |
|---|---|
| ***G08G 1/07*** | (2006.01) |
| ***G08G 1/16*** | (2006.01) |
| ***G08G 1/056*** | (2006.01) |

(52) U.S. Cl.
CPC ..... *G08G 1/164* (2013.01); *G08G 1/056* (2013.01); *G08G 1/07* (2013.01)

(58) Field of Classification Search
None
See application file for complete search history.

(56) References Cited

U.S. PATENT DOCUMENTS

| | | | | |
|---|---|---|---|---|
| 9,234,960 | B1 * | 1/2016 | McIntosh | G01S 5/18 |
| 2013/0063282 | A1 * | 3/2013 | Baldwin | B61L 29/282 340/941 |
| 2015/0356871 | A1 * | 12/2015 | Kugel | G01C 21/3697 340/935 |
| 2017/0032668 | A1 * | 2/2017 | Al-Deek | G08G 1/056 |

* cited by examiner

*Primary Examiner* — Adolf Dsouza
(74) *Attorney, Agent, or Firm* — John Chandler

(57) ABSTRACT

Methods and systems are described for providing improved detection of a motor vehicle traveling against a designated direction of travel in a roadway. Multiple signals among various system constituents are checked against each other to ensure the lack of a false wrong way indication otherwise possible by use of a single detector. An alert is provided to the wrong way motor vehicle operator and other vehicle operators in the vicinity of detection. A long-range or cellular communication may be broadcast to further provide an alert of a wrong way event and to dispatch emergency personnel to the vicinity.

19 Claims, 12 Drawing Sheets

WRONG WAY ALERT

CROSS-REFERENCE TO RELATED APPLICATIONS

This application claims priority to, and the benefit of, U.S. provisional patent application filed on 9 Oct. 2015 and having Ser. No. 62/239,789.

BACKGROUND

Field

This disclosure relates to increased success in detecting a motor vehicle improperly traveling against a designated direction of travel, reconciling signals among various system constituents to ensure the lack of a falsely positive identification of a wrong way event by a single detection signal, and providing an alert to the motor vehicle operator and to others in the vicinity of detection including to other vehicle operators who are most at risk of harm.

Description of Related Art

Over the last few decades, there has been a steady stream of catastrophic incidents related to head-on collisions. This occurs when a confused driver, operating a motor vehicle, enters a roadway traveling in the opposite direction to a designated direction of travel. While some drivers are driving while intoxicated, many drivers are lawfully operating their vehicles. For example, many drivers are just confused by placement of a new on-ramp, are driving under dark or severe weather conditions, or in locations with which they are unfamiliar. The result is the same—vehicles traveling against a designated direction of travel. Many of these instances occur in places where the speed of travel is high such as on divided freeways and the like.

Unfortunately, a confused driver often travels a substantial distance in the wrong direction before realizing what has happened. In all too many situations, a head-on collision occurs because the drivers and vehicles traveling properly in the correct direction do not expect a driver and vehicle to be traveling against their lane of traffic, and simultaneously the at-fault driver is not aware of the mistake. The speed of travel of many at-risk vehicles is often at or near freeway speeds. Head-on collisions usually involve catastrophic damage including death and severe bodily harm. Many of these incidents can be avoided.

There have been numerous attempts to create wrong way detection systems to prevent head on collisions between such vehicles. However, these systems have not been widely implemented and suffer from some significant deficiencies. Often, the systems are excessively expensive. Cities, counties and other transportation planners are reluctant to make large purchases based on the equipment expense alone. Further, even where warranted, these systems fail to identify all wrong way drivers, provide too many false alarms or false detections, and demand excessive maintenance in terms of monitoring and equipment upkeep.

In the case of a false detection or false detection, it is highly disruptive to dispatch emergency personnel and vehicles to a certain vicinity when no actual wrong way driver is operating a vehicle in a direction opposite to regular traffic flow. Often, when emergency personnel arrive in the area, it is too late and the damage has been done. While some detection systems have been successfully implemented, the cost has been excessive for the vast majority of potential installation points. Complicating this fact, only a few incidents per month or per year actually occur at particular at-risk locations. However, in the aggregate, substantial harm to families and communities continues to happen every year due to avoidable head-on collisions.

SUMMARY OF THE INVENTION

Described herein are devices that can form part of a system for detecting a vehicle traveling against a designated direction of travel on a roadway. An illustrative system comprises various components or devices including a first vehicle detector and a second vehicle detector or wrong way detector (WWD), or a doppler detector (DD). Each detector is oriented with or opposite to a direction of vehicle travel so as to implement a zone of detection in a roadway. The zones of detection from each device may overlap so as to form a combined zone of detection. Each detector monitors vehicles and objects traveling in a proper direction of travel and detects objects traveling against the proper direction of travel.

Each detector includes a network component or circuitry through which the detector communicates with other components in the system. A first detector broadcasts status and detection information to a second detector, and vice versa. One or more of the detectors in the system preferably includes a long range network component configured to deliver alerts asynchronously with operation of the first detector and second detector. A long range network component can take the form of a TDMA or CDMA cellular circuit so as to provide data and notifications to traditional cellular devices and to government and non-government emergency personnel.

The system also preferably includes one or more wrong way notifying devices (WWND) or components. The notifying device may include a network component and/or long range network component through which it communicates with one or more other components in the system. A notifying device is placed a sufficient distance from a wrong way detector so as to alert an operator of a wrong way vehicle and alert others to an emerging wrong way incident or event. The notifying device may include an audible, visual or other type of alert. One example of a WWND is a flasher bar attached to existing wrong way signs.

In short, the system includes three basic components: flasher bars or light panels, light panel controllers, and radar detection units. These components are designed with low power consumption and may be powered or partially powered by solar units.

This summary is provided to introduce a selection of concepts in a simplified form that are further described below in the detailed description. This summary is not intended to identify key or essential features of the claimed subject matter, and thus is not intended to be used to limit the scope of the claimed subject matter.

BRIEF DESCRIPTION OF THE DRAWINGS

While the appended claims set forth the features of the disclosure with particularity, the disclosure, together with its objects and advantages, is more readily appreciated from the following detailed description, taken in conjunction with the accompanying drawings. Throughout, like numerals generally refer to like parts. Unless specifically indicated, the components and drawings are not shown to scale.

DETAILED DESCRIPTION

Overview.

The present disclosure solves many of the shortcomings of known systems and methods for detecting wrong way drivers and alerting others to such emergent circumstances. Substantial savings in life and bodily harm can be obtained by using the information described herein. Prototypes and testing have been done to ensure that the described techniques and devices function reliably as described.

Since the beginning of automobile use, there has been a significant need to detect and alert wrong way drivers and others at risk. Wrong way drivers can occur in a variety of circumstances on both one-way and two-way roads. For example, an inattentive driver may be driving against traffic on a one-way road, or in an inappropriate lane on a two-way road.

It has only been recently that advances in electronics and computer networking have enabled the operation of sufficiently advanced, sufficiently reliable and sufficiently fast communication between devices to occur. As described herein, a system has been developed which provides significant benefits and advantages over previous techniques and equipment. Further, recent advances in electronics and computer networking have reduced the cost of a system that can be easily deployed in many more locations. The following disclosure provides further details.

Figure 1:
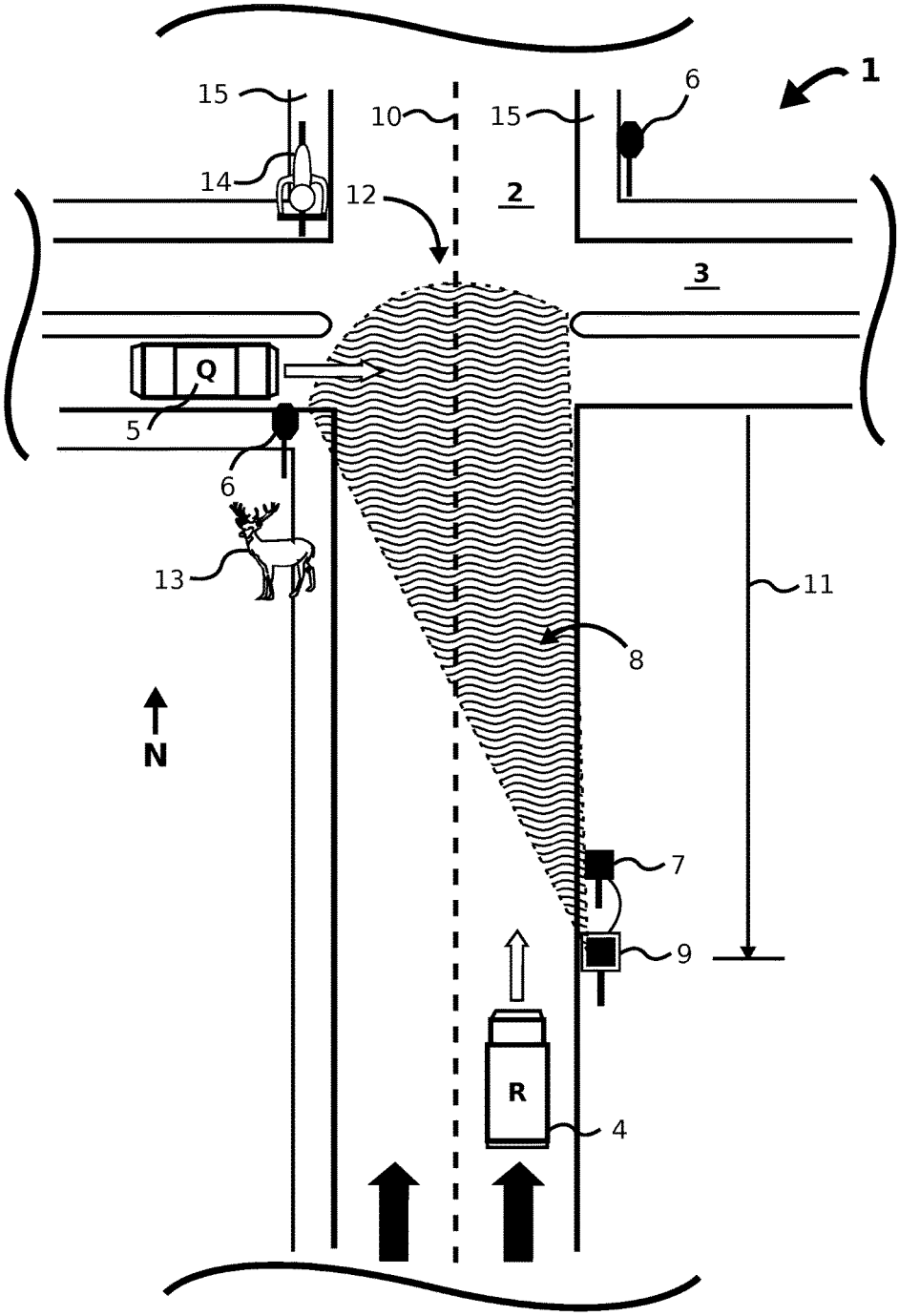
FIG. 1 shows a schematic overhead view of a crossroad and single wrong way detector.

FIG. 1 shows a schematic overhead view of a small portion of a crossroad and single wrong way detector (WWD). With reference to FIG. 1, the overhead view 1 includes a vertically oriented one-way road 2 that intersects with a horizontally oriented two-way road 3. The two-way road 3 runs from east to west or left to right. The one-way road 2 includes two lanes of travel, and arrows indicate the allowed direction of travel. A first car 4 marked "R" is advancing northbound or upward in FIG. 1 as indicated by the travel arrow. A second car 5 marked "Q" is stopped at a stop sign 6. The driver of the second car 5 intends to cross the first and one-way road 2, and to proceed to the right on the second road 3 as indicated by the arrow. Without any familiarity with the roads 2, 3 and the intersection, the driver of the second vehicle 5 may be at risk for turning right onto the first road 2 and thereby may be at risk for causing a head-on collision. This may be especially true if the center line 10 marked on the first road 2 is faintly painted white or is difficult to detect in terms of color, or if there is no additional sign indicating that no right turn is allowed. The risk may be exacerbated by poor visibility due to prevailing weather conditions including snow or rain on the ground.

To hopefully detect a wrong way event, a first radar detector or other vehicle detector 7 is installed a distance 11 away from the intersection 12. The first detector 7 emits radiation, light, or other detective means which provides for a field of detection 8. The particulars of detectors are more fully described below in relation to other figures. Returning to FIG. 1, the first detector 7 is capable of detecting moving objects within its field of detection 8. Objects traveling in a desired or allowed direction do not trigger a wrong way alert by the first detector 7. That is, the first detector 7 can be tuned to detect the first vehicle 4 traveling north and tuned to not generate an alert as this type of travel is safe and expected. The first detector 7 can be tuned or configured to only trigger a wrong way alert when a vehicle is traveling south in the first road 2.

Sometimes, false detections or falsely identified wrong way events can be generated by a single detector 7 if the first detector 7 is not configured or tuned properly. For example, the first detector 7 may detect a large animal 13 such as a deer or bicyclist 14 traveling from north to south and proximate to the first road 2 such as on the sidewalk 15. Such event is generally not a wrong way event worthy of detection and alarm. The bicyclist 14 is likely to not cause a head-on collision with traffic on the first road 2 as there is a sidewalk 15 to accommodate southbound pedestrian traffic and similar type movement. Emergency personnel should not be dispatched in such circumstance. Such detection would be a false detection or falsely identified wrong way event. A deer loose in the vicinity of road 2 is not generally a significant driving hazard when compared to an oncoming vehicle that is traveling against traffic. A first detector 7 generally cannot distinguish between traffic on the sidewalk 15, and within the field of detection 8, and traffic in the road 2.

As found in conventional practice, a single detector 7 cannot distinguish false wrong way events even if tuned properly to exclude relatively small objects. For example, depending on environmental and weather conditions, the single detector 7 may interpret small vibrations or movement in a large stop sign 6 as a wrong way event. The vibrations could be caused by winds or other environmental condition. The vibrations could occur not only in the stop signs 6, but could occur in the detector 7 as the detector 7 may also be mounted on a post similar to that of traditional stop signs. Accordingly, a false positive event could occur in a variety of ways and via a variety of means. The single detector 7 may interpret motion or vibratory movements of the stop sign 6 as a car traveling southbound.

Further, a false detection may occur when the single detector 7 detects the second vehicle 5 traveling from left to right and slightly from north to south. In such circumstance, an ordinary observer would immediately recognize that the vehicle 5 is merely traveling across the intersection 12 and toward the east. A similar mis-identification could occur if a car reversed out and onto the first road 2 from a driveway (not shown) between the intersection 12 and the first detector 7 before traveling on its way northward. Such vehicle would not necessarily be a hazard and a proper wrong way event, but could possibly trigger a properly tuned, single detector 7 to initiate a wrong way notification or wrong way procedure. Such procedure may include illuminating an electronic sign 9 proximate to the first detector 7. The electronic sign 9 could face southbound and could warn northbound drivers of a wrong way event occurring in realtime. For example, a perimeter of the sign 9 could flash with yellow lights for 30 seconds. Other variations for notifications are possible. For example, the first detector 7 could trigger illumination of a spinning strobe light on the sign 9. In another example, a very loud and audible alert could be generated and emitted by the sign 9. In yet another example, a request may be sent to 911 services to dispatch a police officer or other emergency personnel to the intersection 12 or to the location of the detector 7. Such dispatch would be wasteful when such dispatch is not warranted in the case of a false identification of a wrong way event, a false detection or improper direction of travel detected in relation to a passing vehicle.

Figure 2:
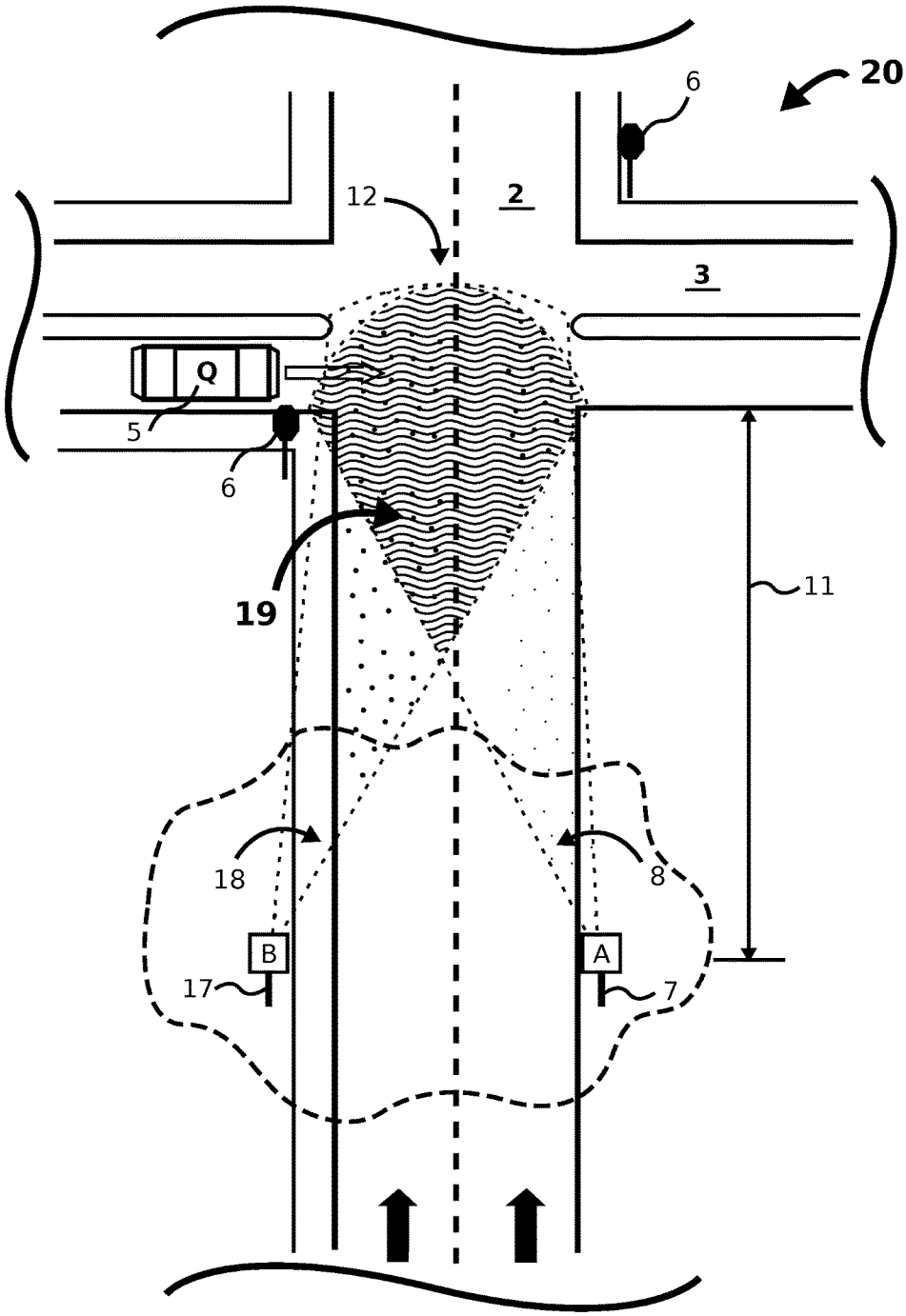
FIG. 2 shows a schematic overhead view of the crossroad shown in FIG. 1 with two wrong way detectors in communication with each other.

Some of the shortcomings illustrated and described in relation to FIG. 1 can be overcome with addition of a second detector. FIG. 2 shows a schematic overhead view of the crossroad 12 shown in FIG. 1 with two wrong way detectors in communication with each other.

With reference to FIG. 2, a first detector 7—labeled "A"—is installed proximate to the first and one-way road 2. Across the north-south road 2 and approximately a same distance 11 from the intersection 12 is installed a second detector 17. The first detector 7 generates a corresponding first doppler-based field of detection 8. The second detector 17 generates a corresponding second doppler-based field of detection 18. In this implementation, and as shown, both fields of detection 8, 18 are pointed generally northward toward the intersection from which a wrong way vehicle is likely to approach the detectors 7, 17. According to another embodiment, the detectors 7, 17 and first and second fields of detection 8, 18 can be directed in opposite directions. Alternatively, according to yet another embodiment, the detectors 7, 17 are oriented at an angle with respect to one another or with respect to a fixed directional vector. In any orientation, both detectors 7, 17 still communicate with each other, and provide the benefits described. Further, note that the second detector 17 can be placed a different distance away from the intersection 12 and not at a same distance 11 as shown in FIG. 2. For sake of convenience of illustration only, the second detector 17 is placed a same distance 11 from the intersection 12.

Preferably, both fields of detection 8, 18 overlap to some degree or amount. The overlap is a combined field of detection 19. The system can be configured to detect a proper wrong way event by only identifying wrong way events as those which involve a wrong way traveling object that passes into, in or out of the combined field of detection 19.

For example, as indicated with respect to FIG. 1, a false wrong way event could be caused by vehicle 5 traveling from left to right. However, with the use of two detectors 7, 17, the vehicle 5 would be detected as approaching the first detector 7, but leaving the second detector 17. Thus, the system comprising the first and second detectors 7, 17 could filter out the improper detection of the moving vehicle 5.

The same methodology of redundancy is also applied to vibrations of one or more elements in the system. For example, if the stop sign 6 were vibrating, the first and second detectors 7, 17 could both take motion and positional measurements, and could compare and harmonize their determination with respect to the stop sign 6 as a potential wrong way object. By experimental observation, a substantial reduction in false alarms was observed with the use of two detectors 7, 17.

In the system shown in FIG. 2, the first and second detectors 7, 17 are in near constant communication with each other through a network 21 indicated with the dashed line. That is, both the first and second detectors 7, 17 include a wireless transmitter and receiver and are within a communication distance of each other. Various possible technologies can be used to implement such an arrangement and specifics are explained in further detail with respect to other figures. According to one implementation, the distance between detectors can be up to approximately 2,000 feet and the network 21 is via a wireless mesh-net (WMN) communication protocol.

During each timeframe, each detector 7, 17 passes one or more current (internal device) statuses of itself to the other. If the first detector 7 is experiencing a malfunction in a timeframe, then only detection results from the second detector 17 should be used and trusted by the system in that timeframe. The system is designed so that it is a rare occurrence when one or more detectors 7, 17 are offline, experiencing a malfunction, in a power-saving mode, and so forth. According to an alternative, each detector 7, 17 only passes a change in status to the other when a change in internal status is detected thereby reducing the need for exchanging information on each communication cycle. Each detector 7, 17 is constantly aware of its own state so that false wrong way detections are avoided by each detector.

Each detector 7, 17 also passes a detection status to each other. Thus, only detection of an object approaching both detectors 7, 17 triggers a wrong way event when both detectors 7, 17 are operational. The system thus has a higher accuracy and higher probability of detecting an actual wrong way event when both detectors 7, 17 are in agreement as to detection of a wrong way object or wrong way event. A wrong way object is an object traveling within one or more of the fields 8, 18, 19 and against an approved direction of travel. A wrong way event is a detection of an object traveling against a preferred or required direction of travel relative to the fields 8, 18, 19. The wrong way event may be detected in multiple successive time intervals. In such circumstance, a stronger confidence is possible for identifying an actual wrong way object and distinguishing a false detection or false alarm from an actual wrong way event.

Figure 3:
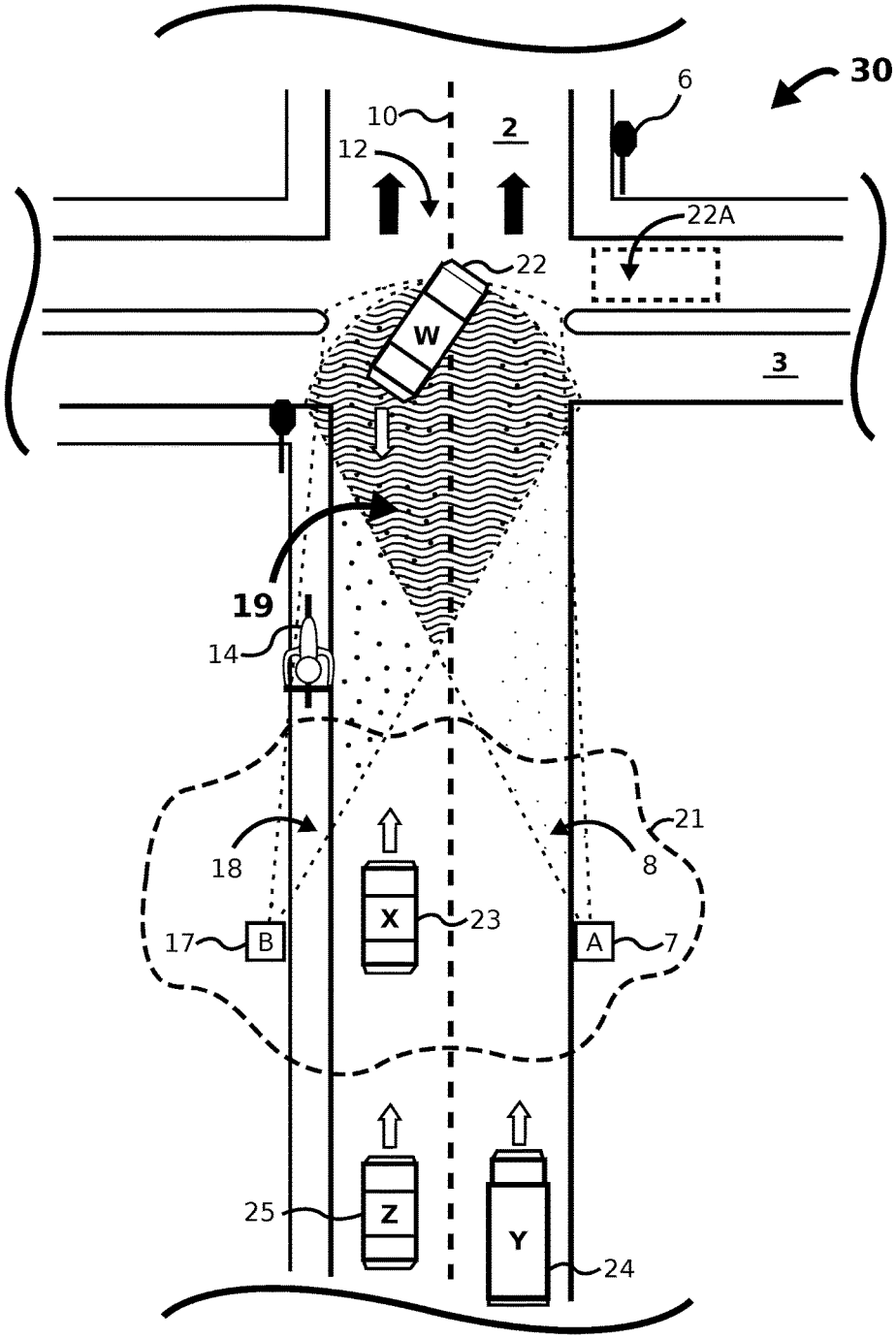
FIG. 3 shows a schematic overhead view of the crossroad shown in FIG. 2 with motorized vehicles present at a first time.

FIG. 3 shows the schematic overhead view 30 of the crossroad shown in FIG. 2 with motorized vehicles present at a first time. FIG. 3 is the first of several figures that illustrate chronologically a wrong way event and alert scenario using the devices described herein.

With reference to FIG. 3, a vehicle 22, marked "W", has left a stopped position 22A in the second road 3 at the intersection 12 and has made an improper left turn into and against the flow of traffic in the first and one-way road 2. The left turn into the first road 2 is improper because vehicles are expected to travel one-way to the north. There may be one or more reasons for this mistake. The driver of the vehicle 22 may be intoxicated, sleep-deprived, or confused based on unfamiliarity with the first road 2 and intersection 12, and may not have seen and recognized markings and signs that would indicate only one-way travel for the first road 2. For example, the lane lines 10 in the first road 2 are all white (not illustratable). Further, there could be one-way signs affixed to the same post as the stop signs 6. The vehicle 22 had properly stopped at the stop sign 6 and could have continued safely to the left or west on the second road 3.

Now that vehicle W (22) is proceeding south in the left lane of the first road 2, several vehicles 23-25 are at risk for impacting or colliding with the wrong way vehicle 22. In particular, vehicles 23, 25 marked respectively X and Z are most at risk because these two vehicles 23, 25 are traveling in the opposite direction in the same left lane of the road 2.

A larger vehicle 24 marked 24 is less at risk, but is still exposed to harm and a potential impact as the drivers of the two vehicles 23, 25 (X and Z) are likely to take emergency action by steering into the right lane of the road 2. Additionally, the driver of the wrong way vehicle W (22) may swerve into the right lane to avoid the first vehicle X (23) and thus may present a risk of head-on collision to the second vehicle Y (24).

Detectors 7, 17 are pointed toward the intersection 12 to detect the wrong way vehicle W (22). Given the configuration and positioning of the detectors 7, 17 marked A and B, respectively, the wrong way vehicle W (22) is not yet detected because it has not yet passed into either the first or second fields of detection 8, 18. Further, the wrong way vehicle W has not yet entered into the combined field of detection 19. The detectors 7, 17 are in communication with each other via a network 21; the network area or range for communication is indicated by the dashed line. The combined field of detection 19 did not detect a wrong way object when the bicyclist 14 passed southward on the sidewalk 15 proximate to the first road 2 based on certain configurations. Each of the detectors 7, 17 is not configured to detect something of that size. Further, the combination of detectors 7, 17 is configured to ignore something of that size (e.g., pedestrian, animal, bicyclist) even if the object, in this scenario, bicyclist 14, did pass through a portion of the combined field of detection 19. Yet further, it is preferable to orient the detectors 7, 17 such that a bicyclist 14 that remains outside of the road 2 only passes through one field of detection 8, 18 at a time, and such that a bicyclist 14 or similar-sized object passes through the combined field of detection 19 for only a very small moment in time as compared to objects traveling in the first road 2. In that way, the detectors 7, 17 working in cooperation can distinguish a bicyclist 14 from a wrong way motor vehicle 22. These configurations are useful because it is sometimes difficult to precisely align a single detector 7, 17 to avoid having its field of detection 8, 18 avoid objects outside of the road 2.

Figure 4:
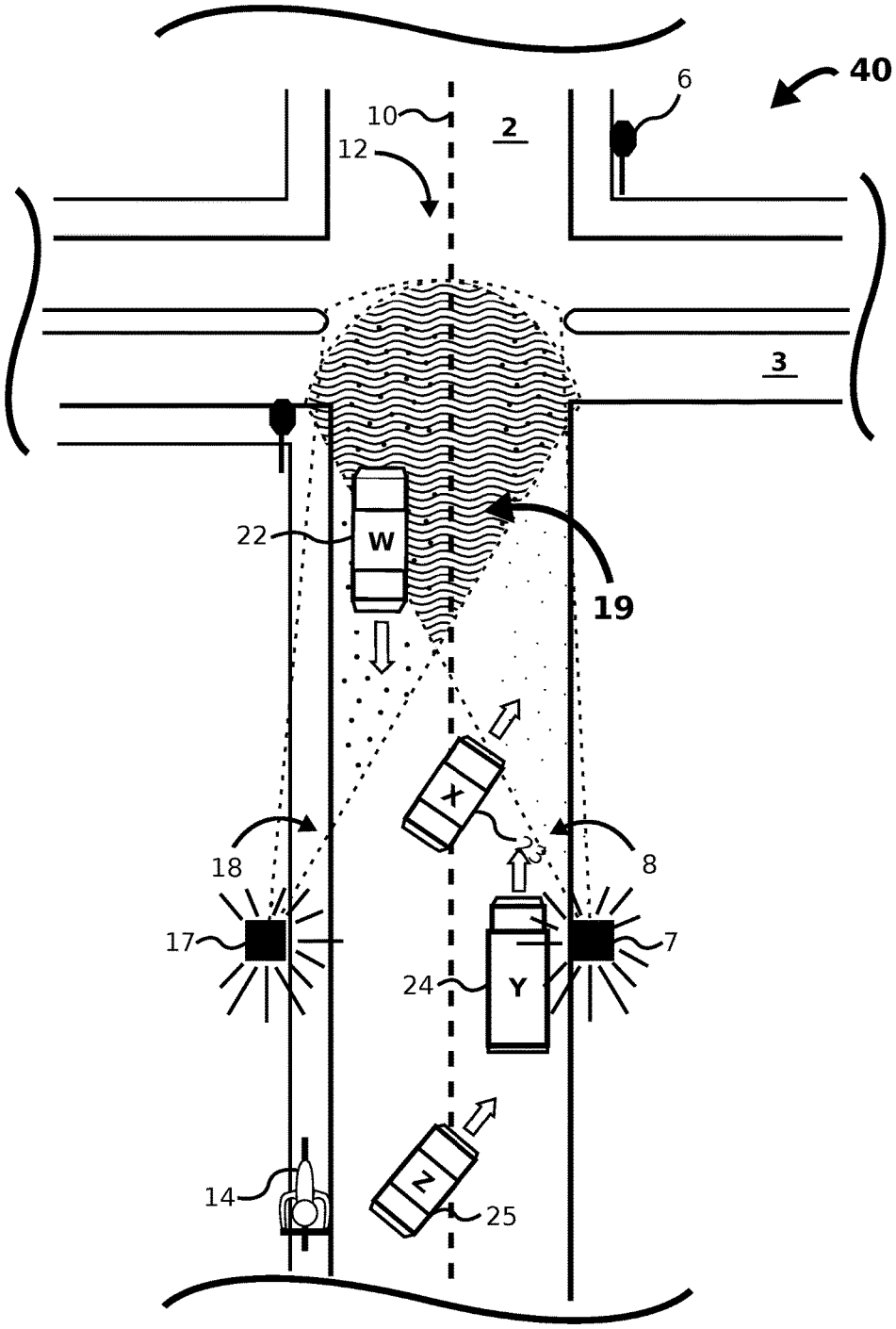
FIG. 4 shows a schematic overhead view of the crossroad shown in FIG. 2 with motorized vehicles present at a second time which is subsequent to the first time.

FIG. 4 shows a schematic overhead view 40 of the crossroad 12 shown in FIG. 2 with motorized vehicles present at a second time which is subsequent to the first time—a snapshot in time. This figure illustrates the scenario perhaps one to two or a few seconds after the initial time illustrated in FIG. 3. As a reminder, figures are not shown to scale.

With reference to FIG. 4, the wrong way vehicle W (22) is fully present in the combined field of detection 19. A wrong way event already has been detected. The vehicle W (22) already passed through the far boundary 27 or outer reaches of the first field of detection 8 and passed through the far boundary 28 or outer reaches of the second field of detection 18. The vehicle W (22) has been detected at least in one common timeframe by both detectors 7, 17. That is, the first detector 7 is time-synchronized with that of the second detector 17. Further, or in the alternative, the vehicle W (22) has been detected in multiple timeframes or detection cycles by each of the detectors 7, 17. The system has been programmed to execute a wrong way alert in such circumstance and has taken one or more actions based on such detection of the wrong way event.

In FIG. 4, each of the detectors 7, 17 has already communicated with the other one that a wrong way event is in progress based on (1) the presence of the wrong way vehicle W (22) in the combined field of detection 19 or independently detected by both detectors 7, 17 in proximate-in-time detection cycles, and (2) a determination that the wrong way vehicle W (22) is traveling southbound relative to both detectors 7, 17. This combined determination has preferably occurred within milliseconds of the vehicle W (22) traveling into the fields of detection 8, 18, 19 and within milliseconds, the detectors 7, 17 have communicated with each other. For purpose of illustration, the vehicle W (22) is shown as already having traveling a bit farther southward than when the event has been detected.

In further detail, since the first detector 7 has detected the wrong way event, and since the first detector 7 has received information that the second detector 8 has also detected the wrong way event, the system overall has more confidence that an actual wrong way event is occurring. The system includes the detectors 7, 17. The system then takes remedial action. In this scenario, the first detector 7 and the second detector 17 are equipped with lights such as yellow or red lights. The lights are illuminated such as by flashing, strobing or illuminating constantly. The illumination or alert is active for longer than the wrong way vehicle W (22) is in the combined field of detection 19. According to one implementation, the alert is active until traffic is returned to a normal flow in the one-way direction as detected by both the first detector 7 and the second detector 17. That way, the lights of these detectors 7, 17 could be illuminated for seconds, minutes or hours depending on the outcome of the wrong way event and its aftermath.

While light-emitting notification components or devices are described, other types of alerts are possible. For example, a sort-range FM broadcast or burst could be generated and broadcast by an alerting device 7, 17 across all FM frequencies. In this way, if any of the drivers of the vehicles operating in the vicinity of the wrong way event were listening to the radio, their listening experience immediately would be altered. An FM or AM broadcast would give the drivers a notification that a significant event is emerging.

Yet other types of alerts are possible. For example, a unique and new (standardized) loud sound could be emitted by each of the alerting devices 7, 17. That way, when persons in the vicinity hear the sound, they would immediately know that a wrong way event is in progress. Yet further, another example of an alert would work as follows. For a device 7 having a cellular circuit available therein, the device 7 would generate and send a signal to the most proximate cellular tower (not illustrated) immediately upon detecting a likely WWE in progress. The most proximate cellular tower (via the base station system (BSS)) would then be responsible to broadcast a free SMS-based text message or other alert originating from the device 7 to each cellular device available in the particular cell. Such messaging could be based on a visitor location register of a participating cellular operator. That way, a widely distributed alert could be broadcast to attempt to minimize potential damage related to the WWE.

Returning to FIG. 4, the detectors 7, 17 are illustrated with lines emanating therefrom communicating that warning lights are provided to the vicinity. For sake of simplicity, the detectors 7, 17 are shown as light-emitting devices. However, in practice, separate alerting devices or components—such as a set of separate light panels—may be co-located with the detectors 7, 17 or may be a short or long distance from each of the detectors 7, 17. A single set of light panels may be actuated by the combination of detectors 7, 17, or each detector 7, 17 may independently communicate with a corresponding or dedicated light panel. The illumination from the detectors 7, 17, or other alerting device, is detectable or visible by the occupants and drivers of the northbound vehicles X, Y and Z (23-25). The alert may also be visible by the driver of the wrong way vehicle W (22) but the vehicle W (22) has not yet deviated from the left lane of the road 2. Based on the system alerts, the drivers of vehicles X and Z (23, 25) are shown to have taken evasive action. That is, vehicles X and Z (23, 25) have begun steering their moving vehicles 23, 25 into the right lane with the intent to avoid oncoming vehicle W (22).

Figure 5:
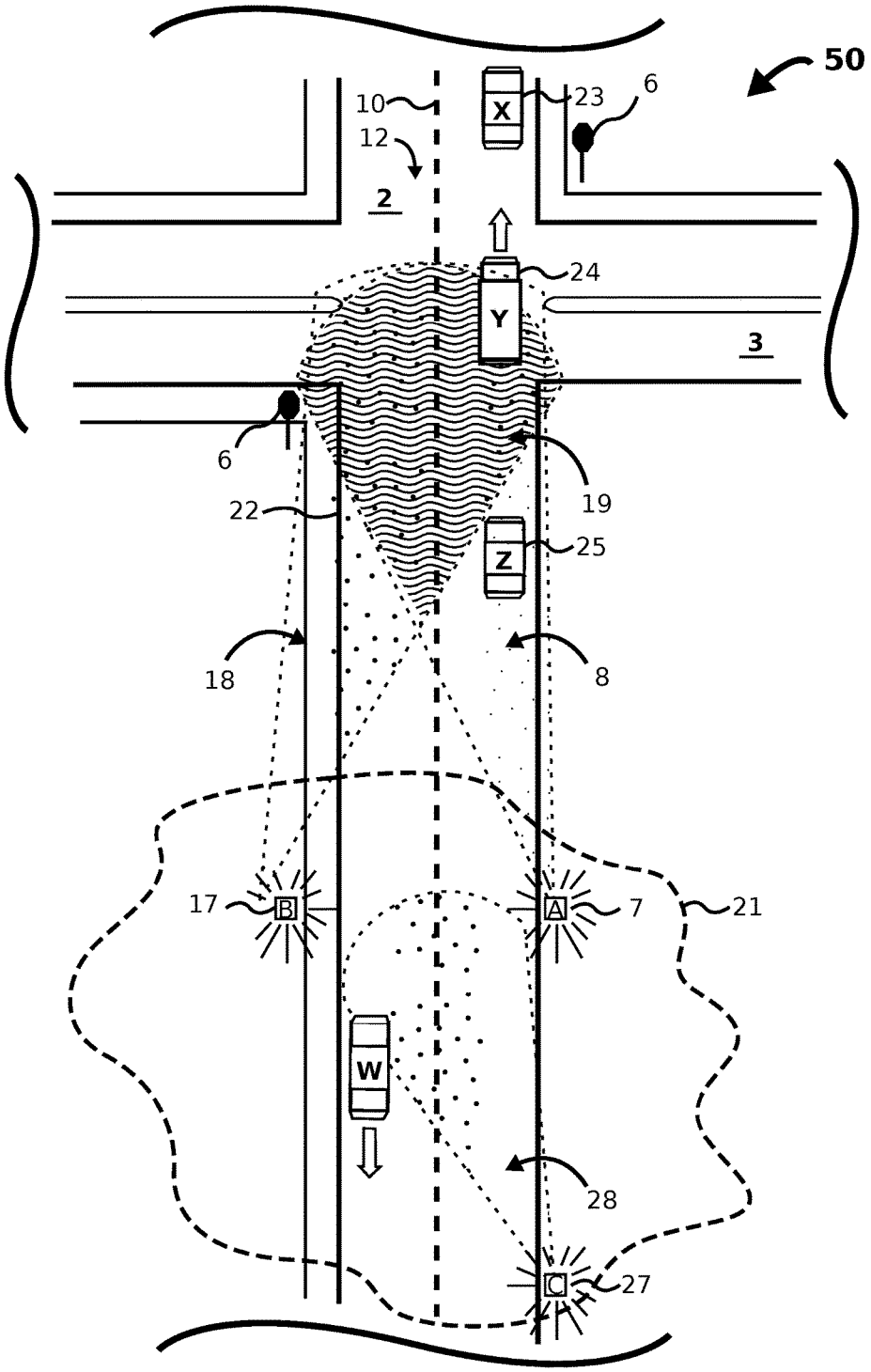
FIG. 5 shows another schematic overhead view of the crossroad shown in FIG. 2 with motorized vehicles present at a third time which is subsequent to the second time.

FIG. 5 shows another schematic overhead view 50 of the crossroad 12 shown in FIG. 2 with motorized vehicles present at a third time which is subsequent to the second time—perhaps a few seconds after FIG. 4 and according to the same scenario shown in FIGS. 3-4. With reference to FIG. 5, the northbound vehicles X, Y and Z (23-25) have proceeded northward and have managed to avoid collision with southbound and wrong way vehicle W (22). The first northbound vehicle X (23) has even managed to pass through the intersection or crossroad 12. The stop signs 6 are for the cross traffic approaching the intersection 12 along the second road 3.

The fields of detection 8, 18 from detectors 7, 17 marked A, B respectively are shown, but the combined field of detection is not shown for sake of simplicity. Because the northbound vehicles X, Y and Z (23-25) continued into the fields of detection 8, 18, the system has determined that traffic flow could have returned to normal. The status of detectors 7, 17 are normal and these detectors 7, 17 are still operating properly. These detectors 7, 17 are still communicating with each other via the network 21.

The system also includes a third detector 27 that projects its field of detection 28 in a northward direction farther south of the first and second detectors 7, 17 and into the road 2. The third detector 27 is also part of the network 21 and is communicating with the first and second detectors 7, 17, and vice versa. The detectors 7, 17, 27 are within a broadcast or network range distance of each other.

The third detector 27 was not shown in FIGS. 3-4 for sake of simplicity. A third detector 27 is optional and benefits may be obtained with use of just first and second detectors 7, 17. The use of a third detector 27 provides additional benefits to the system. The third detector 27 can communicate with the first and second detectors 7, 17 synchronously or asynchronously. The system continues to illuminate the lights associated with detectors 7, 17 because the third detector 27 has detected and communicated the southbound vehicle W (22) that has continued southbound in the road 2. Hence, a wrong way event is likely continuing because of the proximate-in-time nature of the events unfolding and information communicated among the detectors 7, 17 and 27. The system takes advantage of this realtime or near-realtime information. The first detector 7, the second detector 17 or both the first detector 7 and second detector 17 have passed information that has caused the third detector 27 to illuminate as shown by the emanating lines. Preferably, the third detector 27 (via its associated lights) is also illuminated and has been illuminated as soon as the first detector 7, the second detector 17 or both the first detector 7 and second detector 17 have detected the wrong way vehicle W (22) without the wrong way vehicle W (22) reaching the third field of detection 28. That way, northbound vehicles 23-25 have a maximum amount of time to be alerted and to take corrective action as necessary to avoid negative consequences of the emerging wrong way event.

With reference to FIG. 5, just a few seconds after wrong way vehicle W (22) passed by the first and second detectors 7, 17, the third detector 27 picked up a sizable wrong way object in its field of detection 28. Presumptively, this is the same object as wrong way vehicle W (22) because this moving object shares one or more characteristics identified by the first and second detectors 7, 17. According to one implementation, each or just one of the first and second detectors 7, 17 shared this information with the third detector 27 so that the third detector could correlate the shared information with its own information derived from its field of detection 28. For example, the southbound object may be of a same detected size, or it may be of a same or similar speed as that of the object previously detected by the first and second detectors 7, 17 just a few seconds before the third detector 27 detected a southbound object.

The third detector 27 has detected southbound vehicle W (22) in its field of detection 28. The first and second detectors 7, 17 can communicate a speed, direction, size and other detectable information about an object derived from information gained from their respective fields of detection 8, 18. Similarly, the third detector 28 can communicate to the first and second detectors 7, 17 the same types of information, and thus the lights or other alarm functionality of, or associated with, the first and second detectors 7, 17 can be actuated by information received from the third detector 27. At least while the wrong way vehicle W (22) remains in the third field of detection 28, alarms and other actions can be executed. Preferably, alarms and other actions can be executed for a predetermined amount of time after the wrong way vehicle W (22) has left the third field of detection 28, or until disabled by a command communicated from the first detector 7, the second detector 17, or some other component or device associated with or in communication with the devices in the system.

Figure 6A:
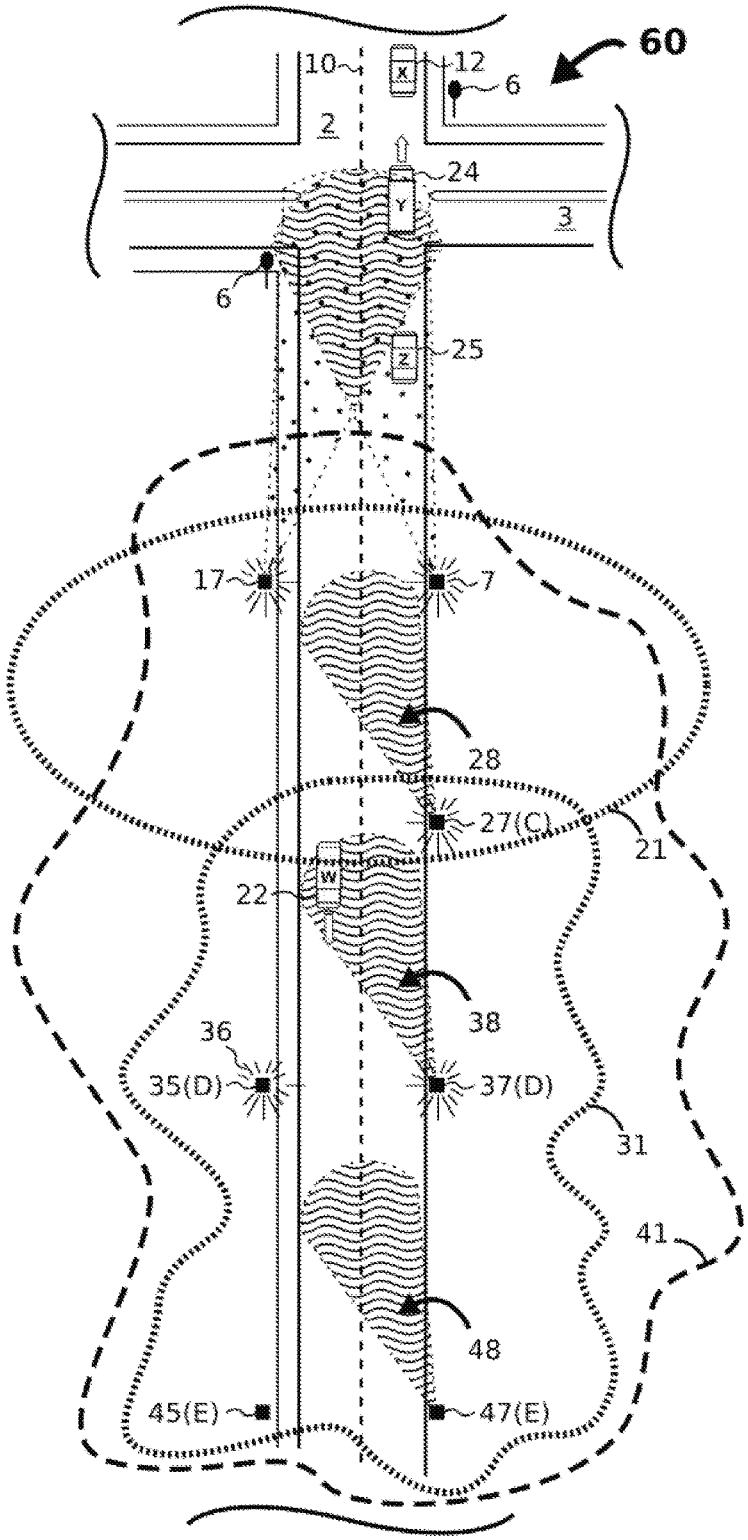
FIGS. 6A, 6B show another schematic overhead view of the crossroad shown in FIG. 2 with motorized vehicles present at a fourth time which is subsequent to the third time.

FIG. 6A shows another schematic overhead view 60 of the crossroad shown in FIG. 2 with motorized vehicles present at a fourth time which is subsequent to the third time illustrated in FIG. 5. The overhead view 60 is taken from a perspective higher than the perspectives of FIGS. 2-5. With reference to FIG. 6A, for sake of illustration, the wrong way vehicle W (22) has advanced yet further south against traffic in the left lane of the road 2. Additional detectors 37, 47, marked respectively D and E, are installed proximate to the road 2. The detectors 37, 47 broadcast doppler-based radiation in a respective field of detection 38, 48. The detectors 37, 47 and their fields of detection 38, 48 are preferably oriented northward as shown but could be installed south-facing since the detectors 37, 47 can detect and distinguish objects traveling in either direction in or near the road 2.

A second communication network 31 and its network range is illustrated by the dashed lines that encircle the third detector 27 and other detectors 37, 47 and devices 35, 45. The distance between the farthest detector 47 from the intersection 12 is too far for the farthest detector 47 to communicate directly with the first and second detectors 7, 17 using a near-field communication protocol or even according to a WMN-communication protocol according to a typical installation geometry, for sake of illustration and according to one scenario. This limitation, according to this scenario, derives from typical vehicle speeds and communication protocols and components used in the system. However, because each of the detectors 7, 17, 27, 37, 47 is equipped with a network component, these devices are programmed with instructions to relay and exchange information among themselves according to the networks 21, 31 and their respective ranges. The devices may exchange information according to either a P2P or star-network configuration. In order to implement the WMN-communication protocol, each of the devices is equipped with one or more technologies described in the IEEE 802.11, 802.15 and 802.16 standards. These specifications and standards are hereby incorporated by reference.

Figure 10:
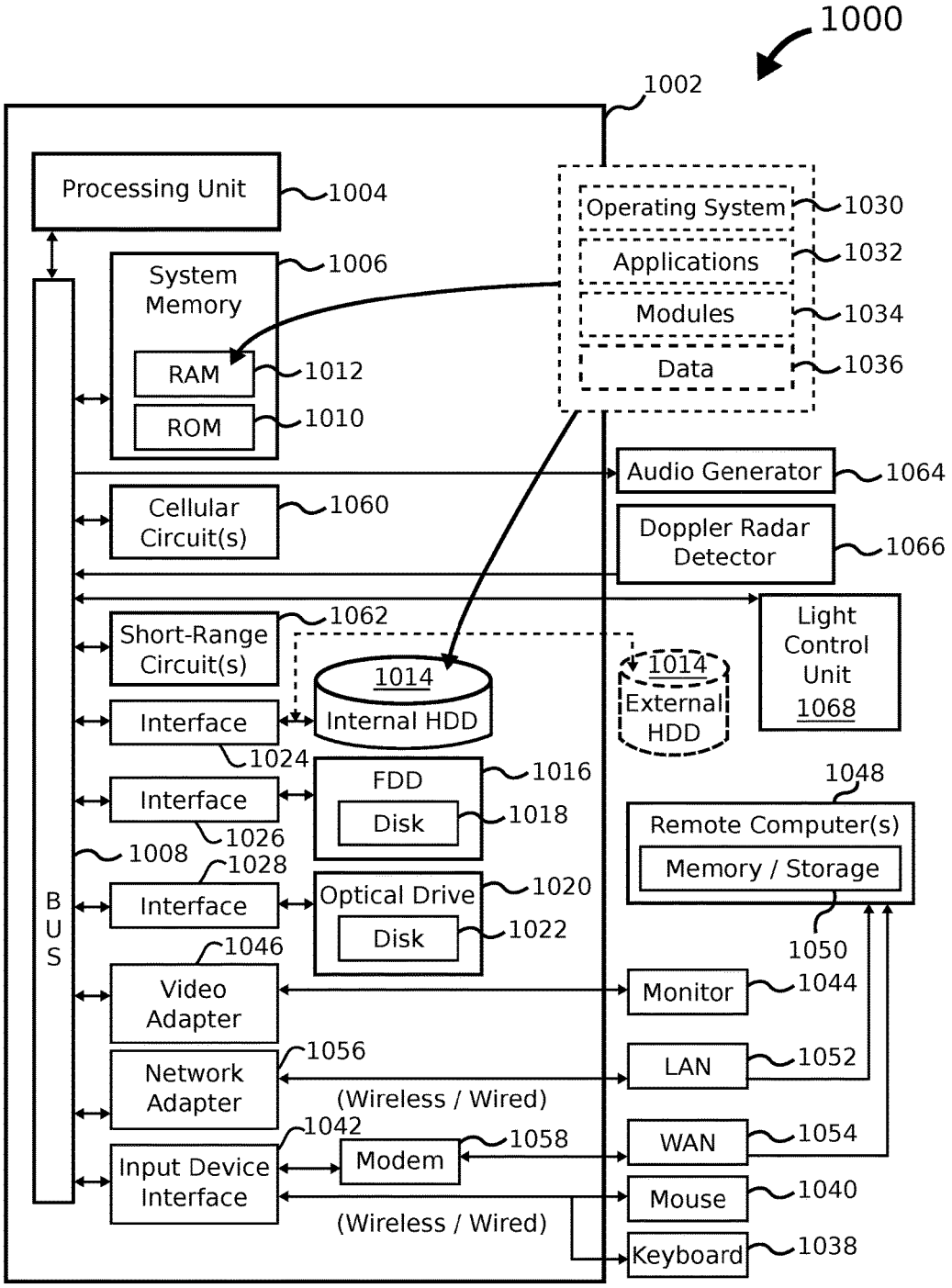
FIG. 10 shows a schematic view of the components of a wrong way detector.

Further, one or more of the detectors and devices may include a second type of network component so as to implement and communicate with a larger (geographically) network of devices 41 and to reach devices outside of those directly involved with detection and alert. Additionally, an alert signal between devices in the system may pass over a second type of network, and thereby require fewer direct connections between devices, depending on the network topology (i.e., location of devices relative to one another) and desired arrangement of the devices in the system. Such signal transfer between detection devices and alert devices over the second type of network may allow for faster relay of an alert between devices. Such a larger network 41 may be implemented with a cellular telephone component that operates on a traditional cellular backbone. One of these cellular components is shown in FIG. 10. Preferably, at least one of the detection devices and alert devices may be equipped with a cellular component.

As shown in FIG. 6A, the system may include additional notification devices such as a notification device D (35) associated with or installed proximate to a respective fourth detector D (37), and likewise another notification device E (45) associated with or installed proximate to a fifth detector E (47). Separate notification devices D, E (35, 45) are shown separately from detectors D, E (37, 47) for sake of illustration only to show how notification components are part of the system. The notification components or devices D, E (35, 45) may form part of or be incorporated into respective detector devices D, E (37, 47), or may be installed on the same pole or sign proximate to the detector devices D, E (37, 47).

The notification device D (35) is shown illuminated with illumination lines 36 because the detector D (37) has successfully detected wrong way vehicle W (22) advancing in a southbound direction against the designated flow of traffic. In one scenario, the detector 37, has communicated with the notification device D (35) to cause the alert condition of notification device D (35). In another scenario, another detector 7, 17, 27 has communicated with the notification device D (35) to cause the alert condition of notification device D (35)

One or more of the detectors 7, 17, 27, 37, 47 includes a long-range component for sending information, a message or data within or outside of the system and within or outside of the view 60 shown. Information communicated via the long-range component(s) may include a request to an emergency response system to dispatch police or other emergency personnel to the area when a wrong way event is emergent. The emergency response system may include generation and transmission of an Amber Alert-like notification. Such notification would be automatically broadcast to cellular devices within a pre-designated range of the detectors 7, 17, 27, 37, 47 so as to minimize delay between detection of a wrong way vehicle W and alerting all persons near mobile devices such as cellular telephones.

The long-range component for a detector 7 may send or receive information from other detectors 17, 27, 37, 47 so as to more quickly activate alarms or take other steps as part of a wrong way event protocol. The use of any long-range component or components is limited so as to reduce power until an increased consumption of power is warranted such as during a wrong way event. For example, the long-range component may take the form of cellular telephone circuitry for sending one or more messages via a cellular signal and cellular network (not shown in FIG. 6A). The long-range components have the capacity to reach devices not shown in FIG. 6A. Several such cellular devices may be reached in rapid succession.

Figure 6B:
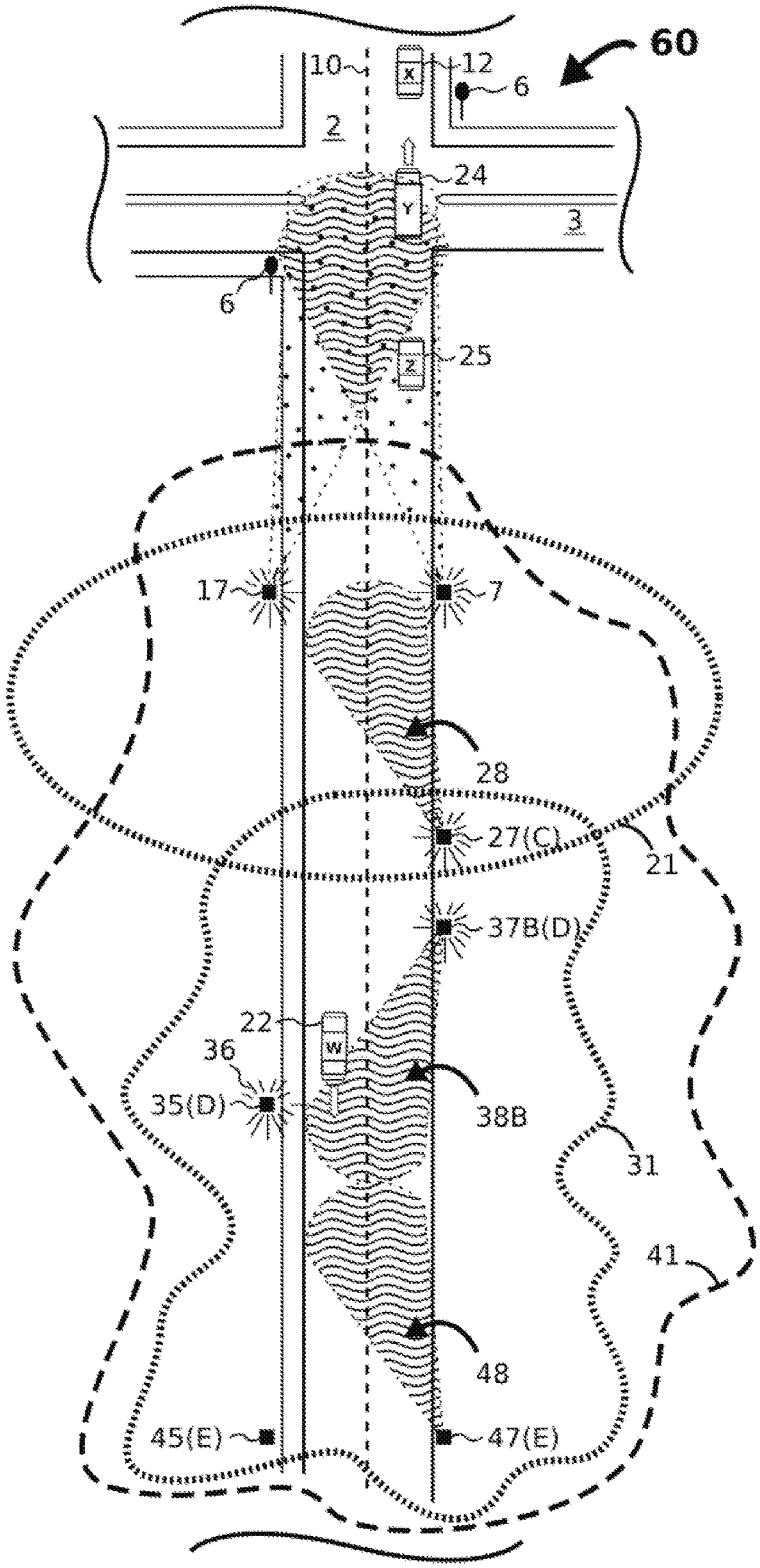

FIG. 6B shows another schematic overhead view 60 of the crossroad shown in FIG. 2. The overhead view 60 of FIG. 6B is similar to the view shown in FIG. 6A. One difference in the system illustrated in FIG. 6B vis-a-vis FIG. 6A is the placement and orientation of the fourth detector 37B. In FIG. 6B, the fourth detector 37B has been turned and projects its field of detection 38B against the expected flow of traffic. FIGS. 6A and 6B illustrate that any of the detectors 7, 17, 27, 37, 37B, 47 and the devices 35, 45 may be oriented in a variety of ways and in a variety of directions so as to provide a best possible system to warn those in the vicinity of a wrong way event to the presence of a wrong way vehicle 22 traveling against an expected direction of travel.

Figure 7:
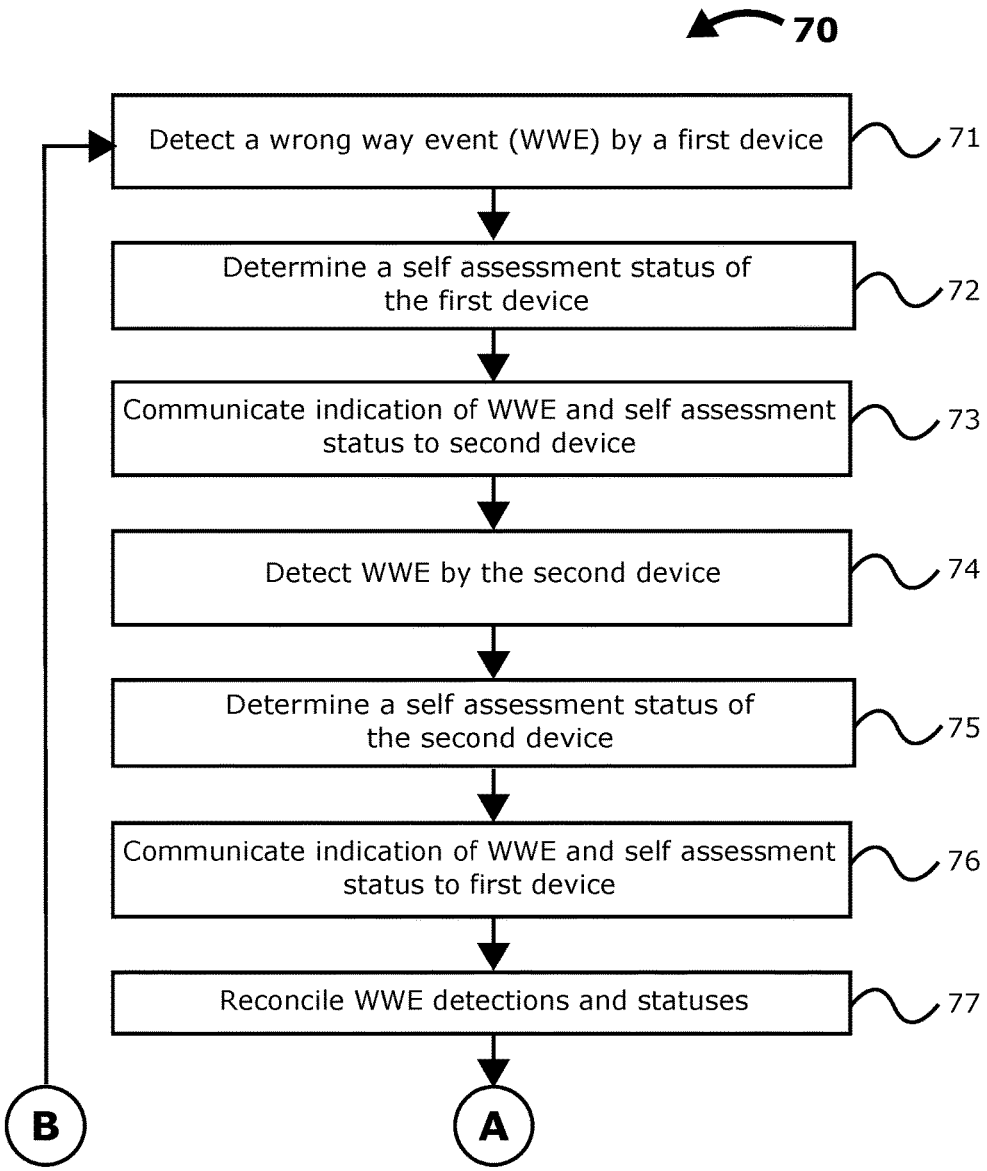
FIG. 7 is a flowchart of high-level logic associated with one implementation of the detection system.

FIG. 7 is a flowchart of high-level logic associated with one implementation of the detection system. In this flowchart, it is presumed that components and devices have been tested, configured and properly arranged relative to a roadway and to each other such as illustrated in FIGS. 2-6. The steps may be performed in any order where feasible. With reference to FIG. 7, a method of detection 70 includes various steps. A first step 71 includes detecting a wrong way event (WWE) by a first device such as a first detector 7. Detection of a WWE includes identifying an object with one or more qualifying characteristics and that is detected as traveling a certain direction relative to the first device. A wrong way is a detected direction that is against a designated or proper direction of motor vehicle traffic.

A second step 72 includes determining a self-assessment status of a first device such as a status associated with the first detector 7. A status indicates whether the first or other device is operating properly. The determination includes information derived from information generated by the electronic components of the first device. The determination may be calculated or determined by the first device or by a second device. The determination may include the failure of the first device to communicate its status within a certain pre-determined time or pre-communicated duration. The self-assessment also may include obtaining information from other devices or components that are external or distant from the first device. There are various reasons why the first device may not be operating properly. For example, the first device may be out of power or reading an unsteady or unusual value associated with a detected object. Operating properly includes determining whether the device is experiencing vibration as detected by an accelerometer component within the detector 7.

A third step 73 includes communicating from a first device to a second device (1) an indication of or data about detection of a WWE and (2) information or data related to the status of the first device.

A fourth step 74 includes detecting a wrong way event (WWE) by a second device such as a second detector 17 illustrated in FIGS. 2-6.

A fifth step 75 includes determining a self-assessment status of the second device such as a status associated with the second detector 17.

A sixth step 76 includes communicating from a first device to a second device (1) an indication of or data about detection of a WWE and (2) information or data related to the status of the first device.

A seventh step 77 includes reconciling the two WWE's detected by the first detector and second detector. Reconciling includes various steps and may include determining if the detections from the first device and the second device can be trusted.

Figure 8:
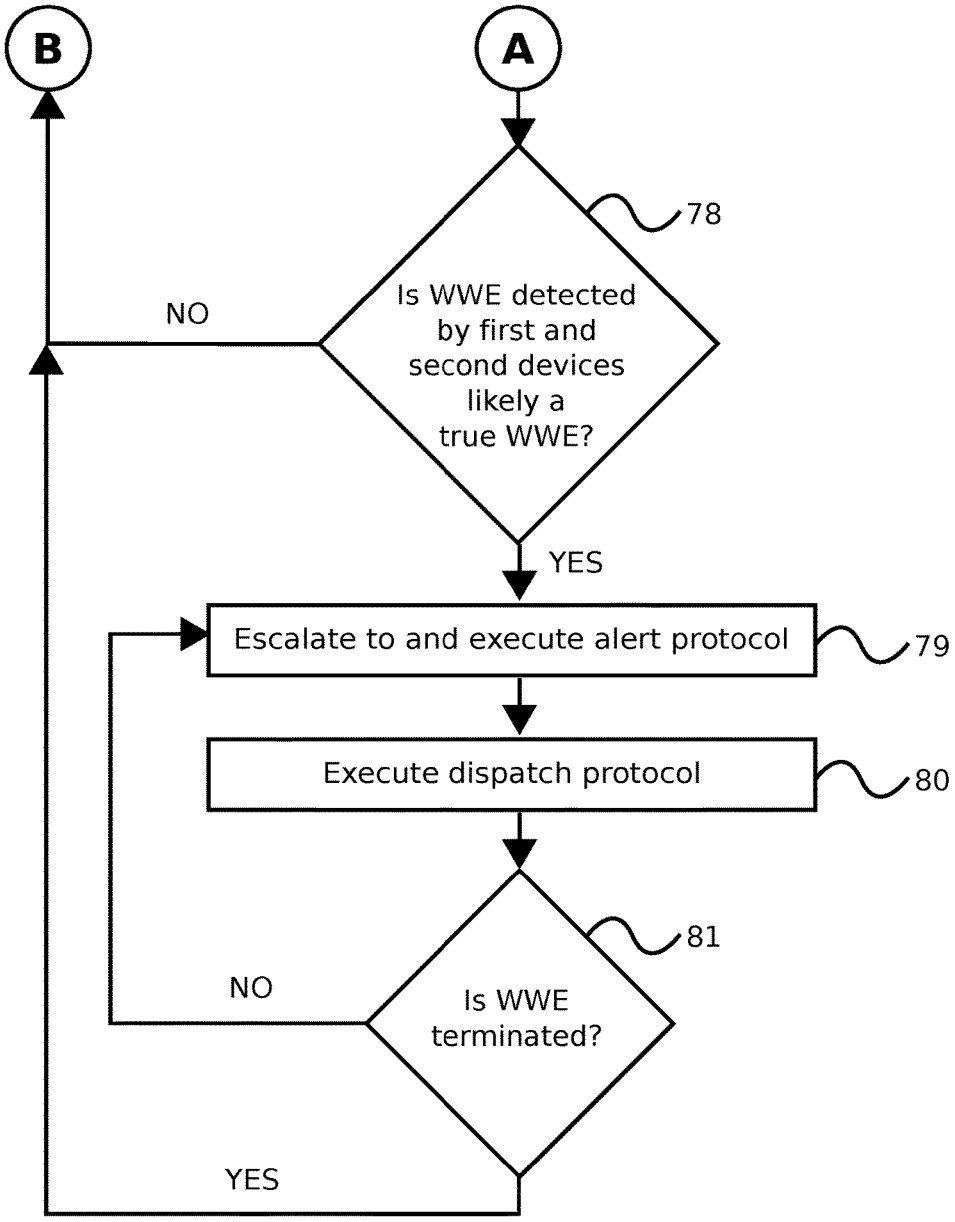
FIG. 8 continues the flowchart begun in FIG. 7.

FIG. 8 continues the flowchart begun in FIG. 7. With reference to FIG. 8, the method 70 continues with another step 78 that includes determining if the wrong way event (WWE) detected by the first and second devices is likely a true WWE. This step 78 includes reconciling the statuses of devices that have detected the WWE and the data that each such device has generated and produced. The logic or computer programming for this step 78 may reside on the first device, second device or some other device. According to one instance, the WWE is likely a true WWE when both the devices are in a viable state (e.g., communicating a working status) and when both devices are detecting an object traveling in a direction contrary to a designated direction of travel.

If the WWE is likely genuine (shown as "yes"), the next step 79 is for the system to escalate to and execute one or more alert protocols. One alert protocol includes activating a flashing light, audible alarm or other device or component proximate to or part of the first device and/or second device. Another alert protocol includes sending a message to all devices in a first network 21 shown in FIG. 6A and subsequently into subsequent networks such as second network 31 shown in FIG. 6A. Further, an alert protocol may involve escalating a communication over a third or wider network such as network 41.

Another step 80 includes executing a dispatch protocol. A dispatch protocol includes having a first device such as device 7 communicate with a government, military or private entity and thereby request or trigger dispatch of emergency personnel. Such dispatch protocol may include communication transmitted by one or more cellular telephone components. Such components typically consume more energy than local network components and therefore escalating to a dispatch protocol is only done for actual (likely) wrong way events. When a WWE is detected, the cellular or long-range network components may require being powered up or activated before broadcasting information and requesting a dispatch of personnel. In this way, the devices in the system that have cellular or long-range network components conserve power until an actual WWE occurs.

The method shown in FIG. 8 continues in the next step 81 by determining if the instant WWE is still in progress. If the WWE is terminated (no longer detected by any of the detectors), the devices (including detectors) are put back into a scanning or stand-by state. If the WWE is still in progress, one or more alert protocols such as at step 79 remain in effect. That is, alarms and alerts are continued until the WWE is determined by the system detectors and/or other components to be over.

Figure 9:
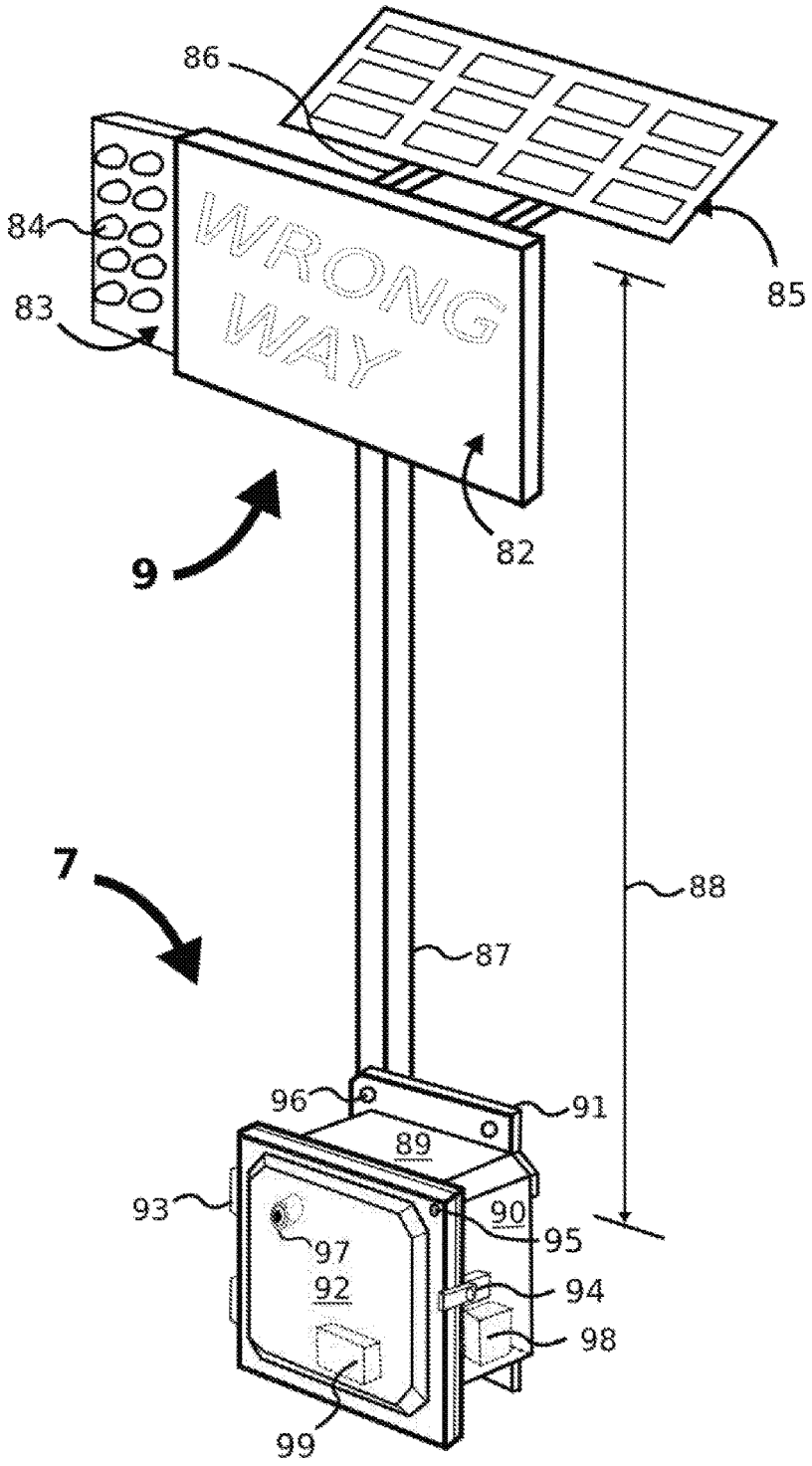
FIG. 9 shows a perspective view of an embodiment of a single wrong way detector and wrong way notification device.

FIG. 9 shows a perspective view of one of many possible embodiments of a wrong way detector and one of many possible embodiments of a wrong way notification device. With reference to FIG. 9, a wrong way detector (WWD) such as the vehicle detector 7 first shown is FIG. 1 is placed at the foot of a sign 9 such as a wrong way sign. The sign 9 may include a static or non-electric portion or sign 82 as well as an electronic light panel 83. The electronic panel 83 may form part of a wrong way notifying device. That is, a wrong way detector may be fitted to existing signage. The system in FIG. 9 includes three components: a doppler radar detection unit 99, a flashing light panel control unit 98, and an electronic light panel 83. The radar detection unit 99 and light panel control unit 98 may both be included in the housing of the vehicle detector unit 7. Alternatively, these two types of components may be assembled inside of their own respective housings.

The light panel 83 includes a set of individual lights 84, LEDs, incandescent lightbulbs, or the like. The light panel 83 may be powered by an external battery or a battery inside of the vehicle detector 7 or inside of the light panel 83 itself. According to one implementation, the light panel 83 is approximately 14 inches by 5 inches by 1 inch thick, and weighs approximately two lbs. According to the implementation, the lights of the light panel 83 include two rows of red LEDs that present a 30 degree cone in terms of visibility, and 2740 candela per square meter. The power source for the light panel 83 can range from 10V to 18V. According to another implementation, a single row of LEDs generally follow a perimeter or a border of the sign 82. The LEDs 84 are mounted to a board that sits over the top of the border of the sign 82 and are recessed below a surface of the board. The LEDs are distributed over the border of the sign 82 in such a manner as to cover at least 25 percent of the border using enough LEDs to make a shape of the sign 82 distinguishable by observers. That is, observers are able to recognize a type of sign 82 based on the additional LEDs 84 attached to the sign. For example, an observer (not illustrated) could distinguish between a stop sign, a yield sign and a wrong way sign based on the shape of the sign 82. According to a variation, at least the LEDs cover at least 35 percent, 45 percent, 50 percent, 55 percent and 60 percent of the perimeter of the sign 82.

The light panel 83 preferably is at least partially powered by a solar panel unit 85. The solar panel unit 85 includes individual photovoltaic sections. The solar panel unit 85 is held at a variable or fixed angle relative to the electronic sign 9 or ground with one or more braces or arms 86. The solar panel unit 85 may provide power to a battery inside the detector 7 (not shown) that then stores power for use by the various electronic components when solar energy is not available. The sign 9 is held a vertical distance 88 above the ground by a post 87. According to one implementation, a solar panel unit 85 provides approximately 20 W at peak solar energy capture. Preferably, each solar panel unit 85 includes motion controller components and supports maximum power point tracking (MPPT). Such components are not shown in FIG. 9 for sake of simplicity. With a solar panel unit 85, each computer 1002 or detector 7, and each light panel 83 unit, can operate for 7-10 days even without significant sunlight.

The WWD or vehicle detector 7 includes internal components that are described in relation to other figures as well as in relation to FIG. 9. In FIG. 9, the vehicle detector 7 also includes a housing formed from at least a top surface 89, a side surface 90, a base 91, and a front panel 92. The front panel 92 is held in place with one or more hinges 93 and a lock 94. The front panel 92 may be further secured with a screw 95 or other fastener. The lock 94 may include a loop and a traditional padlock or other type of securing device attached to the loop that passes through a portion of the panel 92. The lock 94 secures the contents of the housing of the detector 7 against unwanted physical handling, tampering and destruction. The vehicle detector 7 may be secured in place to the ground, the post 87 or other object by a fastener 96 that is part of or passes through the base 91. According to one implementation, the size of the detector 7 is approximately 10 inches by 8 inches by 4 inches and weighs approximately 15 lbs which includes the contents of the detector 7. Other sizes and weights are possible consistent with available components and components chosen for the particular vehicle detector 7.

According to the embodiment shown in FIG. 9, the vehicle detector 7 includes a camera 97 with its lens exposed outside of the front panel 92. In operation, when the vehicle detector 7 detects or is advised of a wrong way event in progress, a controller or other electronic component activates the camera 97 to take a series of pictures so as to capture images of the scene before the front panel 92. The camera 97 may or may not be oriented in a same direction as a detection field generated by the radar detection unit 99. The camera is preferably oriented so as to capture images that may include a wrong way vehicle passing proximate to the vehicle detector 7. According to one embodiment and scenario, the camera 93 captures images (still images or video) in realtime as a wrong way event is in progress. A network component in or associated with the detector 7 broadcasts the images from the location of the detector 7. The images may be made available as part of a wrong way notification or alert of the wrong way event in progress. An emergency alert system or emergency personnel may take advantage of the images or footage captured and broadcast or made available by the camera 93.

The light panel 83 is electrically coupled to the detector 7 such as with a cable (not illustrated). The cable is protected by attaching it to a back of the post 87 and carefully wrapping it from a back of the sign 82 to the light panel 83. The cable wraps around different thicknesses of signs. The flasher assembly or light panel 83 includes a carrier that serves as a support and protection for the cable. The carrier bends around an edge of the sign 82 and terminates in a raceway that conducts the cable to a place of entry into the post 87, the controlling device or detector 7, or both the post 87 and the detector 7.

FIG. 10 shows a schematic view of the components of a single wrong way detector 7 according to a first illustrated implementation. With reference to FIG. 10, a detector 1000 is operable to execute the disclosed technology. FIG. 10 and the following discussion are intended to provide a brief description of a suitable computing environment in which the various aspects of the innovation can be implemented. While the technology has been described above in the general context of controller-executable or computer-executable instructions that may run on one or more devices, those skilled in the art will recognize that the technology also can be implemented in combination with other program modules and/or as a combination of hardware and software.

Generally, program modules include routines, programs, components, data structures and so forth, that perform particular tasks or implement particular data types. Moreover, those skilled in the art understand that the methods can be practiced with other computer system configurations, including single-processor or multiprocessor computer systems, mini-computers, server-scale computers, as well as small computers, hand-held or mobile computing devices, microprocessor-based or programmable consumer electronics such as mobile phones, tablets, phablets, and the like, each of which can be operatively coupled to one or more associated devices.

The described technology may also be practiced in distributed computing environments where certain tasks are performed by remote processing devices that are linked through a communications network. In a distributed computing environment, program modules can be located in both local and remote memory storage devices.

A computer typically includes a variety of computer-readable media. Computer-readable media can be any available media that can be accessed by the computer and includes both volatile and nonvolatile media, removable and non-removable media. By example and not limitation, computer-readable media can include computer storage media and communication media. A computer storage medium can include both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or any other medium which can be used to store the desired information and which can be accessed by the computer. The computer storage medium may or may not be local to the device 1000.

Communication media typically embody computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example and not limitation, communication media includes wired media such as a wired network or direct-wired connection, and wireless media such as acoustic, RF, infrared and other wireless media. Combinations of the any of the above should also be included within the scope of computer-readable media.

With reference again to FIG. 10, the illustrated device 1000 includes a computer 1002. In turn, the computer 1002 includes a processing unit 1004, a system memory 1006 and a system bus 1008. The system bus 1008 couples system components together including, but not limited to, the system memory 1006 and the processing unit 1004. The computer 1002 may be built on a single printed circuit board (PCB) or may be split across multiple such PCBs. The processing unit 1004 can be any of various commercially available processors. Dual microprocessors and other multiprocessor architectures may also be employed as the processing unit 1004.

The system bus 1008 can be any of several types of bus structure that may further interconnect to a memory bus (with or without a memory controller), a peripheral bus, and a local bus using any of a variety of commercially available bus architectures. The system memory 1006 includes read-only memory (ROM) 1010 and random access memory (RAM) 1012. A basic input/output system (BIOS) may be used and the BIOS may be stored in a non-volatile memory 1010 such as ROM, EPROM, EEPROM, which BIOS contains the basic routines that help to transfer information between elements within the device 1002, such as during device start-up. The RAM 1012 can also include a high-speed RAM such as static RAM for caching data.

The computer 1002 further includes an internal hard disk drive (HDD) 1014 (e.g., EIDE, SATA), which internal hard disk drive 1014 may also be configured for external use in a suitable chassis (not shown), a magnetic floppy disk drive (FDD) 1016, (e.g., to read from or write to a removable diskette 1018) and an optical disk drive 1020, (e.g., reading a CD-ROM disk 1022 or, to read from or write to other high capacity optical media such as the DVD). The hard disk drive 1014, magnetic disk drive 1016 and optical disk drive 1020 can be connected to the system bus 1008 by a hard disk drive interface 1024, a magnetic disk drive interface 1026 and an optical drive interface 1028, respectively. The interface 1024 for external drive implementations includes at least one or both of Universal Serial Bus (USB) and IEEE 1394 interface technologies. A flash drive or flash-based memory (not shown) may be plugged directly into a physical adapter of the interface 1024 for providing read/write storage to the computer 1002. Other external storage connection technologies are within contemplation of the detector 7 and device 1000.

The drives and their associated computer-readable media provide nonvolatile storage of data, data structures, computer-executable instructions, and so forth. For the computer 1002, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in the exemplary operating environment, and further, that any such media may contain computer-executable instructions for performing the methods of the technology.

A number of program modules can be stored in the drives and RAM 1012, including an operating system 1030, one or more application programs 1032, other program modules 1034 and program data 1036. All or portions of the operating system, applications, modules, and/or data can also be cached in the RAM 1012. It is appreciated that the technology described herein can be implemented with various commercially available operating systems or combinations of operating systems.

A user can enter commands and information into the computer 1002 through one or more wired/wireless input devices, e.g., a keyboard 1038 and a pointing device, such as a mouse 1040 as necessary. Other input devices (not shown) may include a microphone, an IR remote control, a joystick, a game pad, a stylus pen, touch screen, or the like. These and other input devices are often connected to the processing unit 1004 through an input device interface 1042 that is coupled to the system bus 1008, but can be connected via other interfaces, such as a parallel port, an IEEE 1394 serial port, a game port, a USB port, an IR interface, etc. Additionally, the computer 1002 includes one, two or more inputs that facilitate delivery of signals to the computer 1002 from external devices, components or circuitry such as a camera. One such input is a doppler radar detection unit 1066. While shown as a one-way input, the computer 1002 may provide instructions, control signals and the like to the radar detection unit 1066. The radar detection unit 1066 may have its own operating system, control system, and the like, and may thus only interact with the computer 1002 through the system bus 1008.

A monitor 1044 or other type of display device may also be connected to the system bus 1008 via an interface, such as a video adapter 1046 such as at a startup or a configuration step for operating the detector 7. In addition to the monitor 1044, the computer 1002 may include one or more other peripheral output devices (not shown), such as speakers, printers, etc. One such output is a sound or audio generator 1064. According to one implementation, the audio generator 1064 is a horn rated at 5A max and 30V max. The audio generator 1064 provides an audible warning when a wrong way vehicle is detected by the system.

The computer 1002 may serve as a light or flasher control unit and is thereby connected to one or more electric signs such as electronic sign 9 illustrated in FIG. 9.

Alternatively, the computer 1002 is communicatively coupled (e.g., via wireless network, direct wiring) to a separate light control unit 1068. That is, the computer 1002 and light control unit 1068 could be proximate to each other, or could be separated from each other by 1,000 feet or more. According to one implementation, the light control unit 1068 controls the flasher panel 83 in FIG. 9 and is a unit separate from the detector unit 7 illustrated in FIG. 9. A separate light control unit 1068 includes its own housing. According to such implementation, the light or flasher bar control unit 1068 is approximately 6 inches by 6 inches by 4 inches in dimension. The light control unit 1068 includes its own power source such as a battery. By way of illustration, a battery is a NiMH 10 Ah sized battery with a 12V output. Such battery could provide operation for approximately 10 days without recharging such as by an accompanying solar power unit. A total weight of the light control unit 1068 is approximately 15 lbs including a battery. The light control unit 1068 preferably includes two or more programmable inputs and two or more field outputs. For example, the outputs could include a horn or audio generator, and a beacon (e.g., 2 each 12 W max, DC low-side driver output).

With reference again to FIG. 10, the computer 1002 may operate in a networked environment using logical connections via wired and/or wireless communications to one or more remote computers, such as a remote computer(s) 1048, light control unit 1068, and so forth. The remote computer(s) 1048 can be another detector 7, or a workstation, a server computer, a router, a personal computer, portable computer, microprocessor-based entertainment appliance, a peer device or other common network node, and typically includes many or all of the elements described relative to the computer 1002, although, for purposes of brevity, only a memory/storage device 1050 is illustrated. The logical connections depicted include wired/wireless connectivity to a local area network (LAN) 1052 and/or larger networks, e.g., a wide area network (WAN) 1054. Such LAN and WAN networking environments are commonplace, and facilitate network communications.

According to a preferred implementation, the computer 1002, light control unit 1068 and other remote devices communicate with each and establish wireless mesh-net communications. A typical working range for such a mesh-net is approximately 2,000 feet. The signal is repeatable for longer ranged communications in a single doppler detection system. Group identity is selectable by network ID, subnet ID and/or channel (4 available in a current version of the devices). The peer participants provide AES-128 encryption of communications between nodes or peers. Various configurations are possible. According to one implementation, the nodes communicate with each other via DSSS (direct sequence spread spectrum, aka direct sequence code division multiple access (DS-CDMA)). Data transmissions are sent on selectable channels. Network message ID codes are available. Further, the configuration software is protectable by password to reduce the likelihood of unwanted interference or re-programming when the devices or nodes are placed into service (and are not physically supervised) in the wireless network.

When used in a LAN networking environment, the computer 1002 may be connected to a local network 1052 through a wired and/or wireless communication network interface or adapter 1056. The adapter 1056 may facilitate wired or wireless communication to the LAN 1052, which may also include a wireless access point disposed thereon for communicating with the wireless adapter 1056.

For participating in the networks shown in FIGS. 2-3 and 5-6, the computer 1002 may use one or more cellular circuits 1060 and/or one or more short-range circuits 1062. The short-range circuit(s) 1062 enable the DSSS communications. Through the cellular circuit(s) 1060, the system is able to generate and send live email messages, SMS texts, and provide smartphone notifications (e.g., such as via direct-to-app messages). According to one implementation, the cellular circuit(s) 1060 are CDMA (Verizon®) compatible, and the cellular circuit 1060 includes a ½ wave omni direction antenna with a 2.3 dB gain. Other components and implementations are possible.

The computer 1002 can generate various notifications including: a wrong way violation at each detector, a low battery notification for each device in the system, a device offline status, a system online status, an impact detection, and a door opened (device improperly accessed) notice. The impact detection is generated by an accelerometer (not shown in FIG. 10) that is part of or attached to each computer 1002. The accelerometer also provides a status or positional indicator—a non-movement indicator—internally to the computer 1002 so that the computer 1002, and thereby the doppler radar detector 1066, are advised that the radar detector readings are reliable for each given measurement cycle. Measurement cycles are typically in the frequency range of micro-seconds or milliseconds.

Further, each computer 1002 or remote computer 1048 includes logging such as through in-memory (RAM) logging or writing to a database on an internal storage such as internal HDD 1014. For in-memory logging, intermittently, the log records may be broadcast to an out-of-system data storage location. Such logging preferentially includes time-stamped events. Such events include, for example, each wrong way violation, each right way traffic event, intermittent summary of right way traffic volume (right way traffic volume report), system status (system monitoring), component power status, system or device access (e.g., door opened, acceleration event), and impact detection.

When used in a WAN networking environment, the computer 1002 can include a modem 1058, or is connected to a communications server on the WAN 1054, or has other means for establishing communications over the WAN 1054, such as by way of the Internet. A modem 1058, which can be internal or external and a wired or wireless device, is connected to the system bus 1008 via a serial port interface 1042. In a networked environment, program modules depicted relative to the computer 1002, or portions thereof, can be stored in the remote memory/storage device 1050. It will be appreciated that the network connections shown are exemplary and other means of establishing a communications link between the computers can be used, as previously described.

Generally, each computer 1002 in the system is operable to communicate with wireless devices or entities operatively disposed in one or more wireless communication ranges as described previously in relation to at least FIGS. 2-3 and 5-6. The computer 1002 may participate via a short-range communication, a cellular communication via a cell tower, a communication to or from a satellite, or to or from any piece of equipment associated with a wirelessly detectable tag. This computer 1002 and system includes at least one of a Wi-Fi (IEEE 802.11 standard) technology, a Bluetooth wireless technology, a TDMA or CDMA wireless technology, a ZigBee (IEEE 802.15.4 standard) technology, or other wireless technology. Thus, the communication can be a predefined structure as with a conventional network or simply an ad hoc communication between at least two devices.

Figure 11:
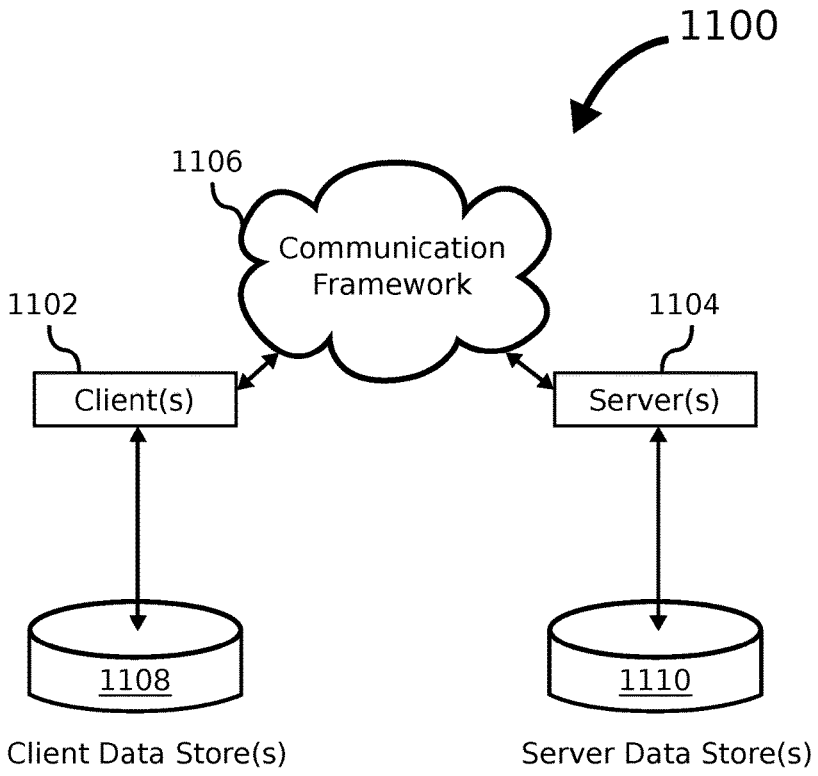
FIG. 11 shows a schematic topology of a network in which a wrong way detector operates.

FIG. 11 shows a schematic topology of a network in which a wrong way detector operates—an illustrative computing environment 1100. Referring to FIG. 11, the system 1100 includes one or more client(s) 1102 such as a WWD 7 or notification device 35. The client(s) 1102 can be hardware and/or software (e.g., threads, processes, computing devices). The client(s) 1102 can house physical memory components loaded with information; the information may include contextual information by employing the technology described herein.

The system 1100 may also include one or more server(s) 1104 or peers. The server(s) 1104 can also be hardware and/or software (e.g., threads, processes, computing devices). One or more of the wrong way detection devices 7 or notification device 35 may take the role of a server 1104. The servers 1104 can house or operate threads to perform transformations and operate the various hardware components. One possible communication between a client 1102 and a server 1104 can be in the form of a data packet adapted to be transmitted between two or more computer processes. The data packet may include a payload bearing computer-encoded information and/or associated contextual information, for example. The system 1100 includes a communication framework 1106 (e.g., a global communication network such as the Internet or more of a local network such as an ad hoc, wireless mesh-net communication network) that can be employed to facilitate communications between the client(s) 1102 and the server(s) 1104.

Communications can be facilitated between peers, clients/servers and the like via a wired (including optical fiber) and/or one or more wireless technologies. The client(s) 1102 are operatively connected to one or more client data store(s) 1108 that can be employed to store information local to the client(s) 1102 (e.g., data and/or associated contextual information). Similarly, the server(s) 1104 are operatively connected to one or more server data store(s) 1110 that can be employed to store information local to the servers 1104.

CONCLUSION

An advantage of the instant system is the detection of a missing or incorrectly operating detection device or alert-generating device. If the system detects that one of the members is not detecting or registering data as it usually does on a frequent, hourly, daily or other basis, the system can cause or generate an alert for a technician to physically visit the unit before a false negative event happens.

Yet another of the advantages of the instant system is the coupling of regular traffic data with wrong way incident detection. The use of big data techniques can be used to improve the operation of the system specifically in reference to identifying what characteristics are correlative of actual wrong way events. In this way, a constant refinement of identification criteria can be provided to the system. For example, if, at a particular intersection or stretch of a roadway, wrong way incidents occur at certain hours of every night, the frequency of mesh-net communications can be selectively increased so that faster identification can result.

Another advantage of the instant system is a significant reduction in the cost of each of the devices in the system. For example, a detector 7 and detector 17 can be coupled to a cellular communicator or communication circuitry, such as in one device 35 in the system, without deploying significantly expensive assets throughout. Instead, inexpensive mesh network technology can be deployed at most of the nodes or peers in the system. It is by implementing mesh network technology that each unit can participate in the network and contribute significant correlatable data to the system with only a single cellular or other long-range network connector needed for each system deployment.

Yet another advantage is the customization of field inputs combined with one or more of the doppler vehicle detectors. For example, other instruments and instrument data may be added to the time-stamped data from the doppler detectors (devices 7, 17, 27, 37, 47). Instruments such as a temperature recorder, pneumatic sensors placed out into a road and connected to the detectors, ice detectors, visibility detectors, and so forth may be added to the system. Further, their data may be (1) used to further corroborate correct operation of the various devices, and (2) add additional data to the system reports and incident detection algorithms so that more accurate detection of wrong way incidents is obtained. Fewer false alarms and fewer missed wrong way detections are the result.

Although the system has been described with reference to specific embodiments and implementations, it will be evident that modifications and changes can be made to these embodiments without departing from the broader spirit of the disclosure. Accordingly, the specification and drawings are to be regarded in an illustrative sense rather than in a restrictive sense.

Similarly, while certain embodiments have been described and shown in the accompanying figures, it is to be understood that such embodiments are merely illustrative and not restrictive of the broad disclosure and that the provided disclosure is not limited to the specific constructions and arrangements shown and described herein, since various other modifications may be made according to the abilities of those ordinarily skilled in the art upon studying this disclosure. The disclosed embodiments may be readily modifiable as facilitated by enabling technological advancements without departing from the principals of the present disclosure.

We claim:

1. A system for detecting a vehicle traveling against a designated direction of travel on a roadway, the system comprising:

a first doppler detector (DD) placed at a first location proximate to the roadway and oriented in a first direction relative to the roadway, and wherein the direction is measured by a vector emanating from the first DD, and wherein the first DD is operable to broadcast a first doppler signal into the roadway and interpret the same thereby creating a first detection zone, and wherein the first DD includes:

a first accelerometer configured to provide information about movement of the first DD; and a network component through which the first DD communicates with other components in the system, and wherein the first DD is programmed with instructions to routinely broadcast its operational status including information about movement from the first accelerometer and doppler signal interpretation to at least one other component in the system;

a second doppler detector (DD) placed at a second location proximate to the roadway and within a network distance from the first DD, and wherein the second DD is oriented in a second direction relative to the roadway, and wherein the second DD is operable to broadcast a second doppler signal into the roadway and interpret the same thereby creating a second detection zone, and wherein the second DD includes:

a second accelerometer configured to provide information about movement of the second DD; and a network component through which the second DD communicates with other components in the system, and wherein the second DD is programmed with instructions to routinely broadcast its operational status including information about movement from the second accelerometer and doppler signal interpretation to at least one other component in the system; and a wrong way notifying device (WWND) placed proximate to the roadway, and wherein the WWND includes a network component through which the WWND receives information from at least one of the first DD and the second DD, and wherein the WWND is programmed with instructions for generating a notification signal in response to both the first DD and the second DD detecting the vehicle traveling against the designated direction of travel and in response to the first DD and the second DD not experiencing movement based on information from the first and the second accelerometers.

2. The system of claim 1, and wherein the first detection zone overlaps a portion of the second detection zone.

3. The system of claim 1, and wherein the system further includes a cellular network component, and wherein the cellular network component is in communication with one of the first DD, the second DD and the WWND, and wherein the cellular network component is configured with instructions to generate and broadcast an alert message asynchronously with operation of system.

4. The system of claim 1, and wherein the first DD, the second DD and the WWND form an ad-hoc wireless mesh network (WMN).

5. The system of claim 4 and wherein the WMN is formed according to a IEEE 802.15.4 standard.

6. The system of claim 4 and wherein a physical layer of each network component operates within 2400-2484 MHz.

7. The system of claim 1 and wherein the system further comprises:

a third doppler detector (DD) placed at a third location proximate to the roadway and within a network distance from either the first DD or second DD, and wherein the third DD is oriented in a third direction, and wherein the third DD is operable to broadcast a third doppler signal into the roadway and interpret the same thereby creating a third detection zone, and wherein the third DD includes a third accelerometer configured to provide information about movement of the third DD, and a network component through which the third DD communicates with other components in the system, and wherein the third DD is programmed with instructions to routinely broadcast an operational status including information about movement from the third accelerometer and doppler signal interpretation to at least one other component in the system.

8. A method for determining a wrong way event related to a designated direction of travel of motorized vehicles in a roadway, the method comprising:

detecting a vehicle traveling against the designated direction of travel with a first doppler detector, and wherein the detecting includes checking for movement of the first doppler detector via an accelerometer associated with the first doppler detector to confirm that the first doppler detector provides no false reading;

detecting a vehicle traveling against the designated direction with a second doppler detector, and wherein the detecting includes checking for movement of the second doppler detector via an accelerometer associated with the second doppler detector to confirm that the second doppler detector provides no false reading;

communicating, to a notification device, a signal representing detection of the wrong way event by both the first doppler detector and second doppler detector; and generating, by the notification device, an alert signal indicative of a wrong way incident.

9. The method of claim 8, and wherein the alert signal is a flashing light.

10. The method of claim 8, and wherein the alert signal is an audible signal at least 80 dB in strength as measured proximate to the component of origin.

11. The method of claim 8, and wherein the method further comprises:

detecting passage of motorized vehicles traveling correctly according to the designated direction of travel after detection of the wrong way event, said detecting done by either the first doppler detector or the second doppler detector; and communicating to the notification device to cease generation of the alert signal.

12. The method of claim 8, and wherein the method further comprises:

detecting by a third doppler detector passage of motorized vehicles, and wherein the third doppler detector broadcasts direction of travel of each detected vehicle and its status, and wherein the status of the third doppler detector includes information derived from an accelerometer associated with the third doppler detector to confirm that the third doppler detector provides no false reading.

13. A wrong way vehicle detection system, comprising:

a first detector placed at a first location proximate to a roadway and oriented in a first direction, and wherein the first detector is operable to broadcast a first detection signal into the roadway and to interpret the same, and wherein the first detector includes a network component configured with instructions to broadcast an operational status of the first detector and a first detection signal interpretation to other components in the system;

a second detector placed at a second location proximate to the roadway and within a network distance from the first detector, and wherein the second detector is oriented in a second direction, and wherein the second detector is operable to broadcast a second detection signal into the roadway and to interpret the same, and wherein the second detector includes a network component configured with instructions broadcast an operational status of the second detector and a second detection signal interpretation to the other components in the system including the first detector; and a wrong way notifying device (WWND) placed proximate to the roadway, and wherein the WWND includes a network component through which the WWND receives information from at least one of the first detector and the second detector about the operation status of the first detector and the second detector and about the first detection signal interpretation and about the second detection signal interpretation, and wherein the WWND is programmed with instructions to:

generate a notification (1) in response to both the first detection signal interpretation and the second detection signal interpretation indicating a vehicle traveling against a designated direction of travel in the roadway and (2) in response to the first detector and the second detector broadcasting an operational status indicating that each of the first detector and the second detector is operating correctly in a timeframe that includes the first detection signal interpretation and the second detection signal interpretation indicating the vehicle traveling against the designated direction of travel in the roadway; and emit the generated notification.

14. The system of claim 13, wherein the first direction and the second direction are more than 90 degrees out of alignment from each other.

15. The system of claim 13, further comprising:

a third detector placed at a third location proximate to a roadway and oriented in a third direction, and wherein the third detector is operable to broadcast a third detection signal into the roadway and to interpret the same, wherein the third detector includes a short-range network component configured with instructions to broadcast an operational status of the third detector operational status and a third detection signal interpretation to other components in the system.

16. The system of claim 15, wherein the third detector is directed against a first direction of expected travel in the roadway, and wherein the third detection signal covers a portion of all lanes potentially carrying traffic according to the first direction of expected travel, wherein the network components of the first detector and the second detector are short-range network components, and wherein the third detector includes a long-range network component configured with instructions to broadcast a wrong way alert to an emergency responder system when at least two of the first detector, the second detector and the third detector agree upon detection of a wrong way vehicle and when the agreeing devices have had a properly functioning operational status during detection of the wrong way vehicle.

17. The system of claim 13, wherein the first detector includes a first doppler-based detection component and the first detection signal is doppler-based, and wherein the second detector includes a second doppler-based detection component and the second detection signal is doppler-based.

18. The system of claim 13, wherein the first detector includes a first accelerometer, wherein the second detector includes a second accelerometer, and wherein the operational status communicated from each of the first detector and the second detector includes information about a status of each of the first accelerometer and the second accelerometer, respectively.

19. The system of claim 13, wherein the first detector includes a camera oriented toward the roadway, and wherein the first detector is further configured with instructions to capture images of a field of view over a pre-determined period of time when an interpretation of the first detection signal and an interpretation of the second detection signal indicate a presence of a wrong way vehicle.

* * * * *